US010711615B2

(12) United States Patent
Parker et al.

(10) Patent No.: US 10,711,615 B2
(45) Date of Patent: Jul. 14, 2020

(54) FIRST STAGE TURBINE BLADE

(71) Applicant: Chromalloy Gas Turbine LLC, Palm Beach Gardens, FL (US)

(72) Inventors: David G. Parker, Jupiter, FL (US); Zhenhua Xiao, Palm Beach Gardens, FL (US); Richard Yu, Wellington, FL (US); Vincent C. Martling, Wellington, FL (US); Wesley Smith, Boca Raton, FL (US); David Medrano, Okeechobee, FL (US); Charles A. Ellis, Stuart, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 141 days.

(21) Appl. No.: 16/107,363

(22) Filed: Aug. 21, 2018

(65) Prior Publication Data

US 2020/0063565 A1 Feb. 27, 2020

(51) Int. Cl.

| | |
|---|---|
| ***F01D 5/14*** | (2006.01) |
| ***F01D 5/28*** | (2006.01) |
| *F01D 5/30* | (2006.01) |

(52) U.S. Cl.

CPC ..... *F01D 5/141* (2013.01); *F01D 5/288* (2013.01); *F01D 5/30* (2013.01); *F05D 2240/301* (2013.01); *F05D 2240/303* (2013.01); *F05D 2240/304* (2013.01); *F05D 2250/74* (2013.01)

(58) Field of Classification Search

CPC .... F01D 5/141; F01D 5/288; F05D 2240/301; F05D 2250/74

See application file for complete search history.

(56) References Cited

U.S. PATENT DOCUMENTS

| | | | | |
|---|---|---|---|---|
| 6,331,100 | B1 | 12/2001 | Liu et al. | |
| 6,461,110 | B1 * | 10/2002 | By | F01D 5/141 415/191 |
| 6,739,839 | B1 * | 5/2004 | Brown | F01D 5/141 416/223 A |
| 6,769,878 | B1 * | 8/2004 | Parker | F01D 5/141 416/223 A |
| 6,779,980 | B1 * | 8/2004 | Brittingham | F01D 5/14 416/223 A |
| 7,467,924 | B2 | 12/2008 | Charbonneau et al. | |

(Continued)

OTHER PUBLICATIONS

PCT Application No. PCT/US2019/045162, International Search Report and Written Opinion, dated Oct. 29, 2019, 10 pages.

*Primary Examiner* — Kenneth J Hansen
*Assistant Examiner* — Jackson N Gillenwaters
(74) *Attorney, Agent, or Firm* — Avant Law Group, LLC

(57) ABSTRACT

A turbine blade having an airfoil profile substantially in accordance with Cartesian coordinate values of X, Y, and Z set forth in Table 1, where the X and Y values are in inches and the Z values are non-dimensional values from 0 to 1 and convertible to Z distances in inches by multiplying the Z values by the height of the airfoil in inches. The X and Y values are distances which, when connected by smooth continuing arcs, define airfoil profile sections at each distance Z. The profile sections at each distance Z are joined smoothly to one another to form an airfoil shape. The X and Y values may also be scaled as a function of a first constant and the Z values may be scaled as a function of a second constant.

24 Claims, 5 Drawing Sheets

(56) References Cited

U.S. PATENT DOCUMENTS

| | | | | |
|---|---|---|---|---|
| 2005/0111978 | A1* | 5/2005 | Strohl | F01D 5/141 416/97 R |
| 2006/0024168 | A1 | 2/2006 | Fukuda et al. | |
| 2008/0119358 | A1 | 5/2008 | Tsifourdaris et al. | |
| 2008/0273984 | A1 | 11/2008 | Liang et al. | |
| 2009/0269204 | A1* | 10/2009 | Brittingham | F01D 5/141 416/223 A |
| 2015/0247407 | A1 | 9/2015 | Lecuyer et al. | |
| 2016/0102558 | A1* | 4/2016 | Munoz | F01D 5/141 416/95 |
| 2018/0016911 | A1* | 1/2018 | Delabriere | F01D 5/141 |
| 2018/0320528 | A1* | 11/2018 | Bielek | F01D 5/141 |
| 2018/0328181 | A1* | 11/2018 | Marche | F01D 5/141 |

* cited by examiner

FIRST STAGE TURBINE BLADE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention disclosure relates generally to a turbine blade for use in a gas turbine engine and more specifically to surface profiles for a first stage turbine blade.

BACKGROUND OF THE INVENTION

A gas turbine engine typically comprises a multi-stage compressor coupled to a multi-stage turbine via an axial shaft. Air enters the gas turbine engine through the compressor where its temperature and pressure are increased as it passes through subsequent stages of the compressor. The compressed air is then directed to one or more combustors where it is mixed with a fuel source to create a combustible mixture. This mixture is ignited in the combustors to create a flow of hot combustion gases. These gases are directed into the turbine causing the turbine to rotate, thereby driving the compressor. The output of the gas turbine engine can be mechanical thrust through exhaust from the turbine or shaft power from the rotation of an axial shaft, where the axial shaft can drive a generator to produce electricity.

The compressor and turbine each comprise a plurality of rotating blades and stationary vanes having an airfoil extending into the flow of compressed air or flow of hot combustion gases. Each blade or vane has a particular set of design criteria which must be met in order to provide the necessary work to the passing flow through the compressor and the turbine. However, due to the severe nature of the operating environments especially prevalent in the turbine, it is beneficial to optimize the performance of the airfoil.

BRIEF SUMMARY OF THE INVENTION

The present invention discloses a turbine blade having an improved airfoil configuration for use in a gas turbine engine. More specifically, the turbine blade comprises a first stage turbine blade for use in a large frame gas turbine engine.

In an embodiment of the present invention, a turbine blade comprises a blade root, a platform extending from the blade root, and an airfoil extending from the platform. The airfoil has an airfoil shape and a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches. The X and Y values are distances in inches which, when connected by smooth continuing arcs, define airfoil profile sections at each distance Z. The profile sections at the Z distances are joined smoothly with one another to form a complete airfoil shape.

In an alternate embodiment of the present invention, a turbine blade is disclosed comprising a blade root, a platform extending from the blade root, and an airfoil extending from the platform, the airfoil having an airfoil shape. The airfoil has a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches. The X and Y values are distances in inches which, when connected by smooth continuing arcs, define airfoil profile sections at each distance Z. The profile sections at the Z distances are joined smoothly with one another to form a complete airfoil shape. The airfoil shape lies within an envelope of approximately −0.033 to +0.033 inches in a direction normal to any surface location of the airfoil.

In a further embodiment of the present invention, a turbine comprises a turbine wheel positioned along an engine centerline. The turbine wheel has a plurality of turbine blades secured thereto where each turbine blade comprises a blade root, a platform extending radially outward from the blade root, and an airfoil extending radially outward from the platform. The airfoil has an airfoil shape and a nominal profile substantially in accordance with Cartesian coordinate values of X, Y, and Z set forth in Table 1 where the Z values are non-dimensional values from 0 to 1 convertible to Z distances in inches by multiplying the Z values by a height of the airfoil in inches. The X and Y are distances in inches which, when connected by smooth continuing arcs, define airfoil profile sections at each distance Z. The profile sections at the Z distances are joined smoothly with one another to form a complete airfoil shape.

In yet a further embodiment of the present invention, a turbine comprises a turbine wheel positioned along an engine centerline and a plurality of turbine blades secured thereto, where each turbine blade comprises a blade root, a platform extending radially outward from the blade root, and an airfoil extending radially outward from the platform. The airfoil has an airfoil shape and a nominal profile substantially in accordance with Cartesian coordinate values of X, Y, and Z set forth in Table 1 where the Z values are non-dimensional values from 0 to 1 convertible to Z distances in inches by multiplying the Z values by a height of the airfoil in inches. The X and Y are distances in inches which, when connected by smooth continuing arcs, define airfoil profile sections at each distance Z. The profile sections at the Z distances are joined smoothly with one another to form a complete airfoil shape, where the airfoil shape lies within an envelope of approximately −0.033 to +0.033 inches in a direction normal to any surface of the airfoil.

These and other features of the present invention can be best understood from the following description and claims.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The present invention is intended for use in a gas turbine engine, such as a gas turbine used for power generation. As such, the present invention is capable of being used in a variety of turbine operating environments, regardless of the manufacturer.

As those skilled in the art will readily appreciate, such a gas turbine engine is circumferentially disposed about an engine centerline, or axial centerline axis. The engine includes a compressor, a combustion section and a turbine with the turbine coupled to the compressor via an engine shaft. As is well known in the art, air compressed in the compressor is mixed with fuel which is burned in the combustion section and expanded in turbine. The air compressed in the compressor and the fuel mixture expanded in the turbine can both be referred to as a "hot gas stream flow." The turbine includes rotors that, in response to the fluid expansion, rotate, thereby driving the compressor. The turbine comprises alternating rows of rotary turbine blades, and static airfoils, often referred to as vanes.

Figure 1:
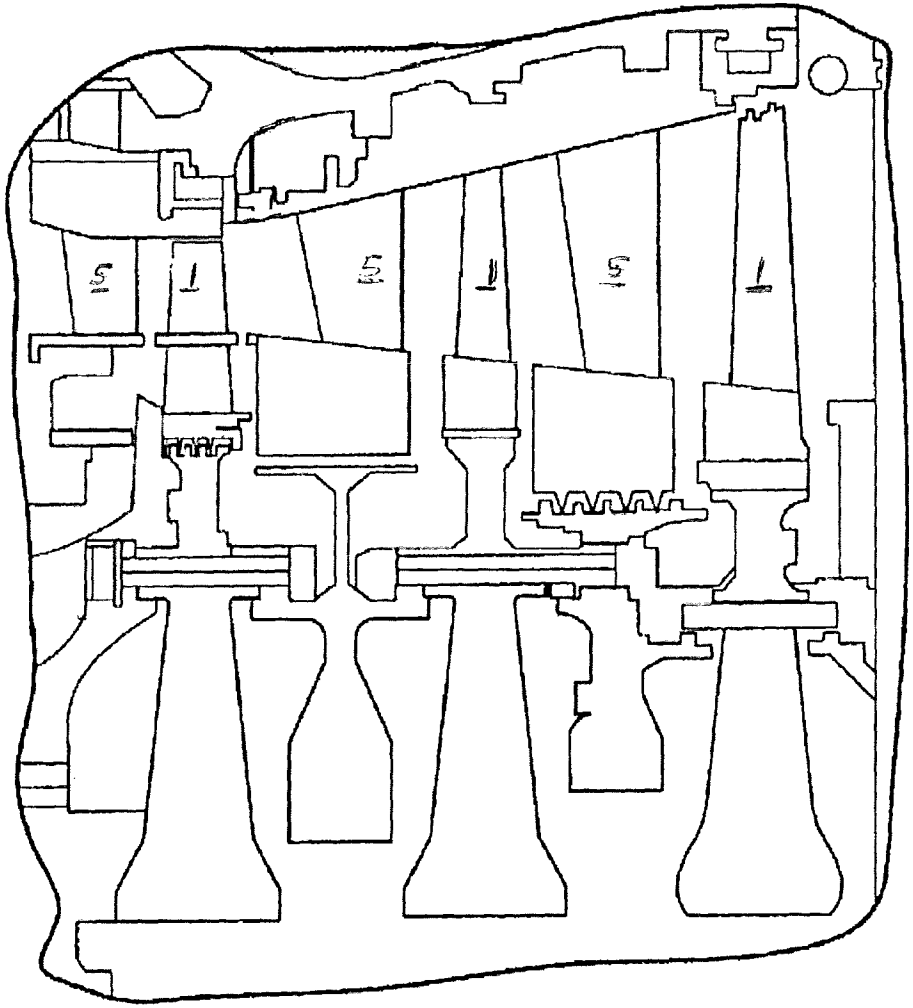
FIG. 1 is a side elevation view of a portion of a gas turbine engine.
Figure 2:
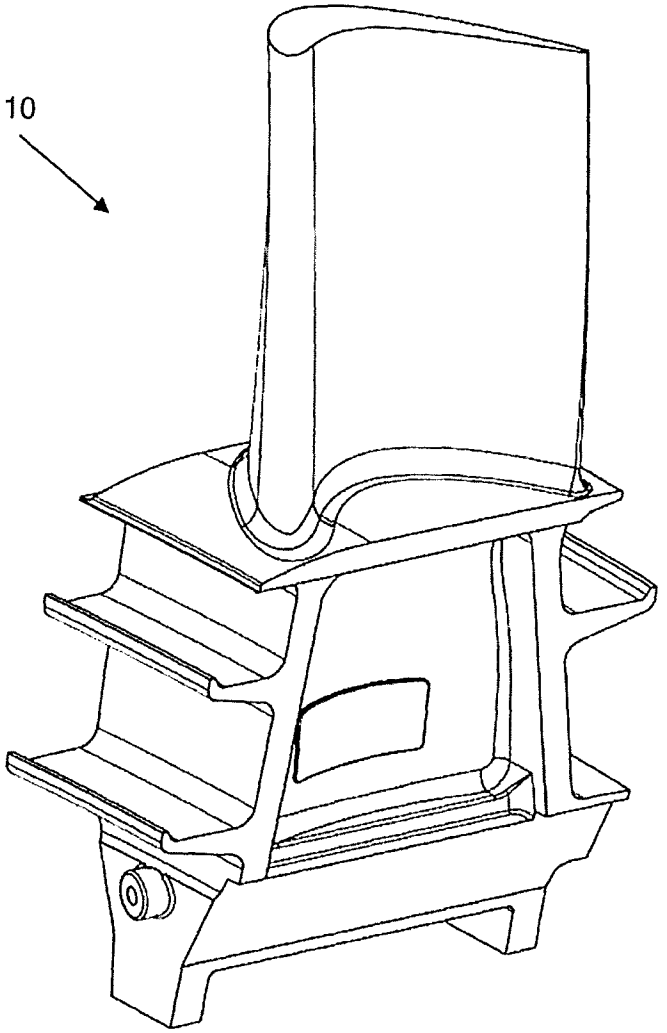
FIG. 2 is a perspective view of a turbine blade casting including an airfoil in accordance with the present invention.
Figure 4:
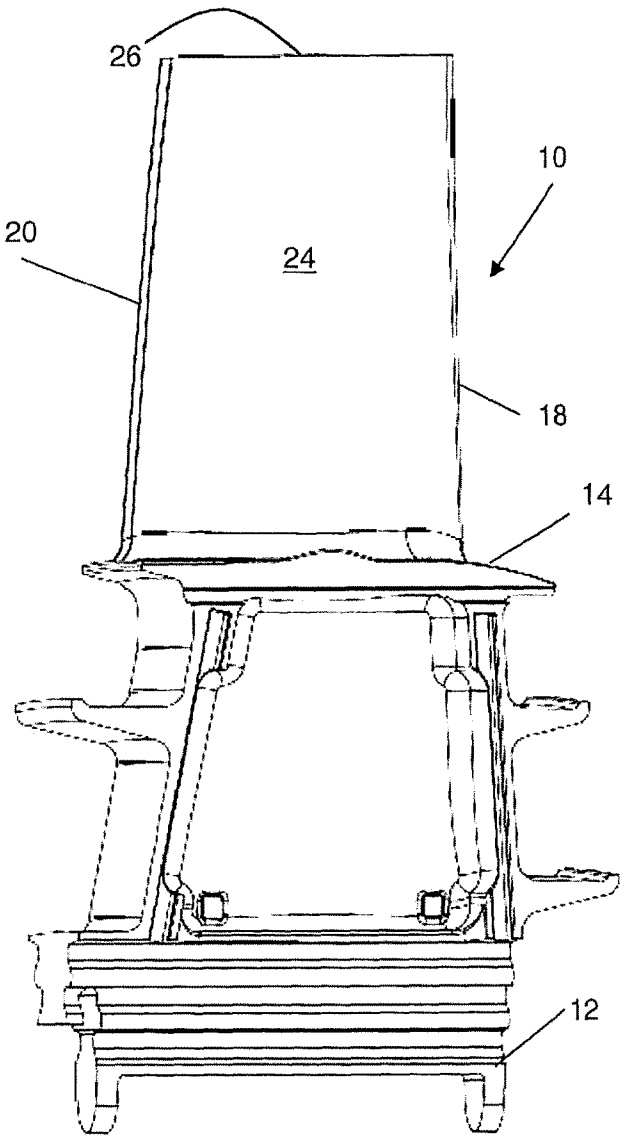
FIG. 4 is an opposing side view of the turbine blade of FIG. 3 including an airfoil in accordance with the present invention.
Figure 3:
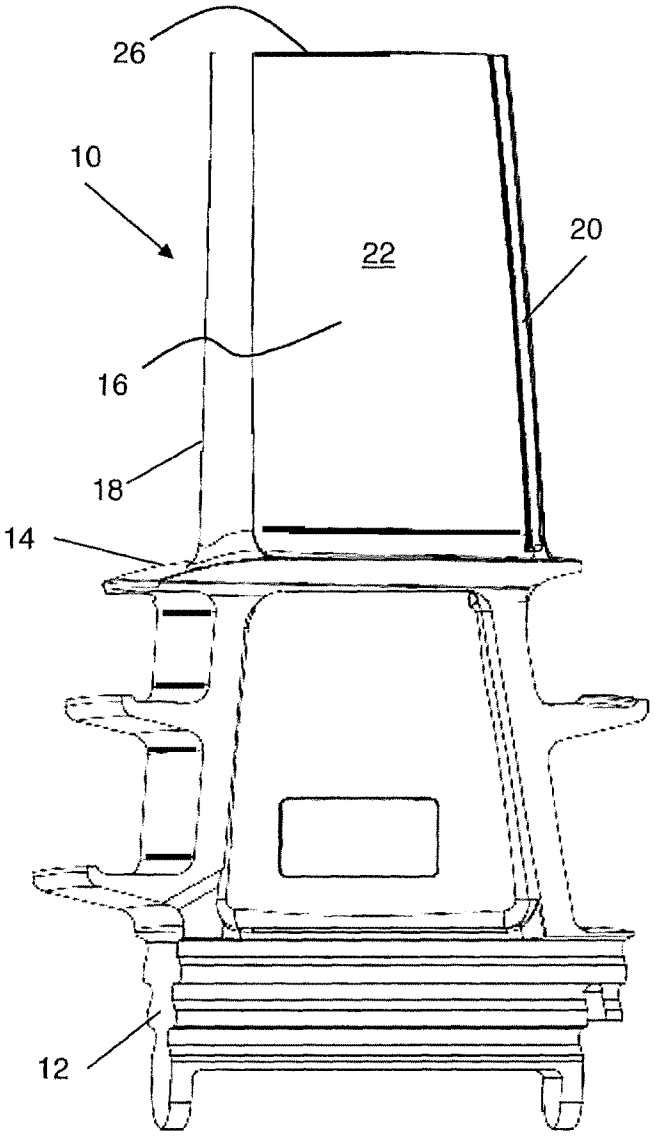
FIG. 3 is a side elevation view of a turbine blade including an airfoil in accordance with the present invention.

A turbine blade in accordance with embodiments of the present invention is shown in FIGS. 1-7. Referring initially to FIG. 1, a cross section view of a portion of a gas turbine engine is depicted. This portion of the engine shows the alternating stages of rotating blades 1 and stationary airfoils 5. Referring to FIGS. 2-4, a turbine blade 10, in accordance with an embodiment of the present invention, is shown in cast form in FIG. 2 and a machined configuration in FIGS. 3 and 4. Turbine blade 10 has a blade root 12, a platform 14 extending from the blade root 12, and an airfoil 16 extending from the platform 14. The airfoil 16 has a leading edge 18 and an opposing trailing edge 20. Extending along the airfoil shape between the leading edge 18 and trailing edge 20 is a pressure side surface 22 having a generally concave shape and an opposing suction side surface 24 having a generally convex shape. The airfoil 16 extends to an airfoil tip 26 located opposite the platform 14.

Figure 7:
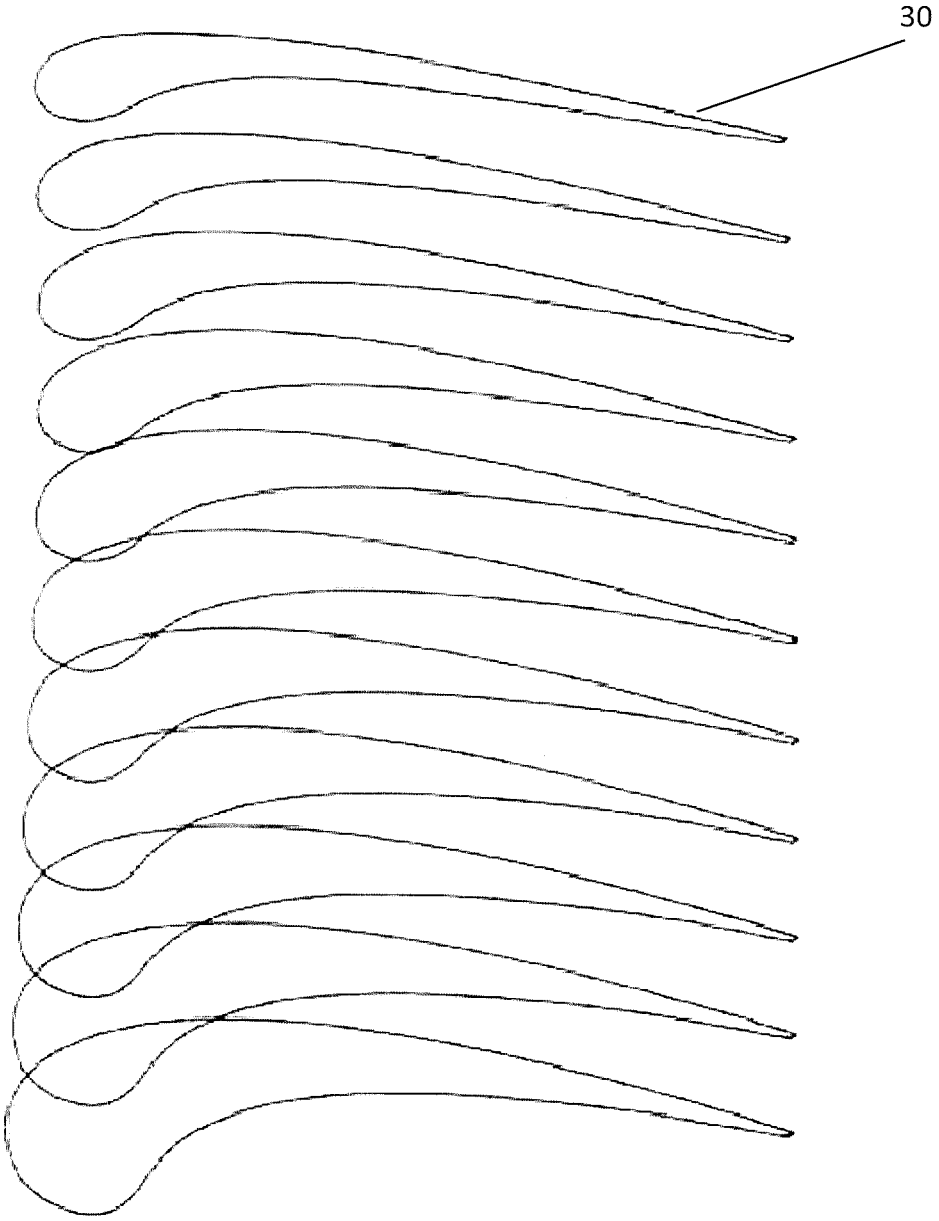
FIG. 7 is a perspective view illustrating a series of airfoil sections formed by the Cartesian coordinates of Table 1.

The airfoil 16 has a nominal uncoated profile substantially in accordance with Cartesian coordinate values of X, Y, and Z as set forth in Table 1 where the Z values are non-dimensional values from 0 to 1 which are convertible to Z distances in inches by multiplying the Z values by a height of the airfoil in inches. The X and Y values are distances in inches which, when connected by smooth continuing arcs, define airfoil profile sections 30 at each distance Z, as shown in FIG. 7. The profile sections 30, as depicted in FIG. 7, at the Z distances are joined smoothly with one another to form a complete airfoil shape.

The turbine blade 10 as disclosed herein is preferably part of a first stage turbine of a gas turbine engine and has an airfoil height of approximately 7.3 inches as measured from proximate a midpoint of the platform 14 to the tip 26 of the airfoil 16. In an alternate embodiment of the present invention, the turbine blade 10 further comprises a coating applied to the airfoil 16. A variety of coatings can be applied to the airfoil 16 in order to improve the airfoil capabilities with respect to the temperatures to which it is subjected in the turbine. One such acceptable coating is a metallic MCrAlY with a diffused aluminide overlay applied up to 0.010 inches thick where the thermal barrier coating maximum thickness is approximately an additional 0.020 inches thick. Such acceptable coatings are applied to all surfaces of the airfoil 16 between the platform 14 and the tip 26.

Figure 5:
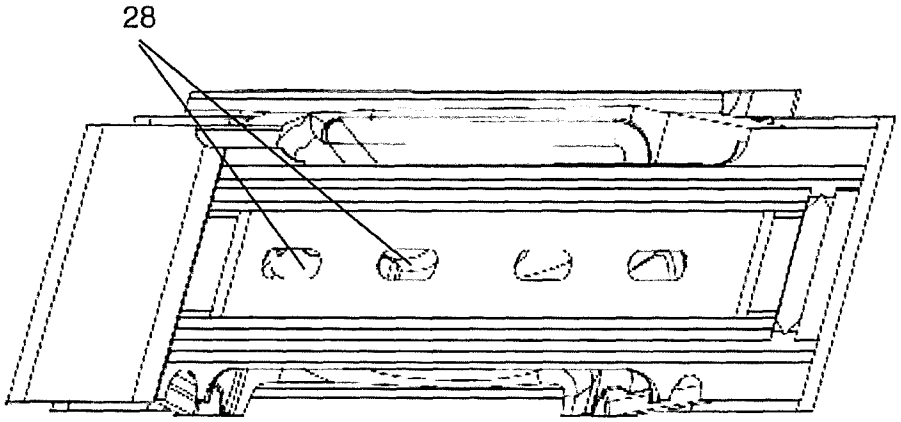
FIG. 5 is a bottom view of a turbine blade in accordance with an embodiment of the present invention.
Figure 6:
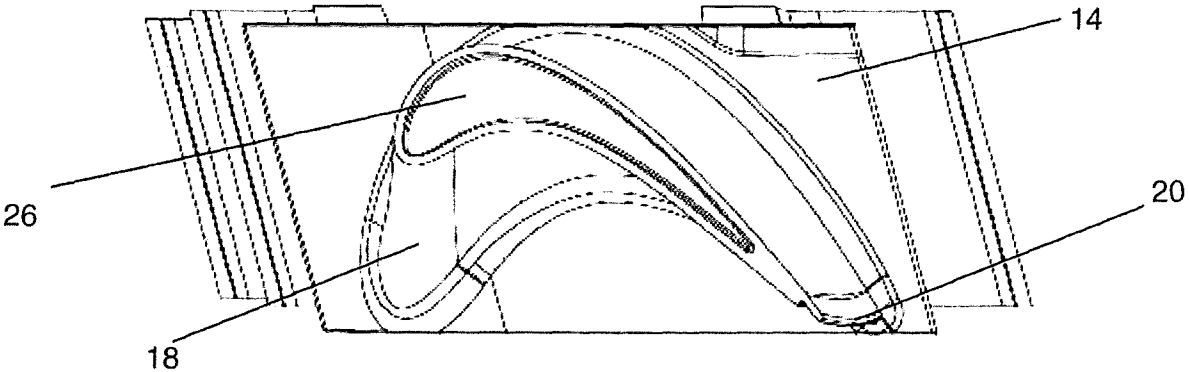
FIG. 6 is a top view of a turbine blade including an airfoil in accordance with the present invention.

Bottom and top elevation view of turbine blade 10 are shown in FIGS. 5 and 6, respectively. The turbine blade 10 includes a plurality of openings 28 extending generally radially through the airfoil 16, from the root 12 to the tip 26. These openings can be used to supply a flow of cooling fluid to the internal sections of turbine blade 10. As one skilled in the art understands, it is necessary to cool certain stages of turbine blades due to their extremely high operating temperatures. A variety of cooling fluids may be used to accomplish this cooling. Openings 28 are designed to be in fluid communication with a cooling supply, such as compressed air, steam, or other fluid and provide the fluid to the airfoil 16 to lower the overall effective temperature of the turbine blade 10. The airfoil 16 is of sufficient size to incorporate various internal cooling configurations such as serpentine cooling and showerhead cooling.

The values of Table 1 for determining the profile of the airfoil are generated and shown to three decimal places. These values in Table 1 are for a nominal, uncoated airfoil. However, there are typical manufacturing tolerances as well as coatings, which can cause the profile of the airfoil to vary from the values of Table 1. Thus, in an alternate embodiment of the present invention, a turbine blade 10, as disclosed above, is provided where the airfoil shape of the cast blade lies in an envelope within +/−0.033 inches in a direction normal to any surface location. That is, due to a variety of manufacturing issues such as variations that occur in airfoil casting and machining of turbine blade 10, the exact location of the airfoil shape can vary by up to approximately +/−0.033 inches. However, such variations in the airfoil profile still result in an airfoil fully within the desired performance of a first stage turbine blade that is within the scope of the present invention.

The present invention can also be used in a variety of turbine applications. That is, the airfoil 16 is designed such that its profile is scalable for use in a variety of gas turbine engines. In order to scale the airfoil 16, the X and Y values are multiplied by a first constant, which can be greater or less than 1.0, and the Z values are multiplied by a second constant. Typically, the X and Y values are multiplied by the same constant while the Z values are multiplied by a second constant, which may be different from the first constant.

In addition to scaling the airfoil 16, the orientation of the airfoil can also change in alternate embodiments of the present invention. More specifically, the airfoil orientation can rotate with respect to an axis extending radially outward from each airfoil section, or along the Z values. This axis can be the stacking axis of the airfoil 16. As one skilled in the art will understand, rotating the orientation of the airfoil 16 can reconfigure the aerodynamic loading on the blade, resulting in a change in the amount of work produced by the turbine blade 10 as well as the mechanical stresses on the blade.

The turbine blade 10 of the present invention has an airfoil 16 that has been designed with many unique features. More specifically, turbine blade 10 has a different pressure side cutback trailing edge configuration than prior art turbine blades. Furthermore, airfoil 16 has a thinner trailing edge 20 than prior art turbine blades. That is, the airfoil 16 has a trailing edge 20 having a thickness of approximately 0.093 inches compared to prior art blades having a trailing edge thickness of approximately 0.279 inches. Such a thinner trailing edge, in combination with the other airfoil coordinates generates an airfoil 16 having lower pressure loss at the mid-span of the airfoil 16, compared to prior art turbine blades. Furthermore, the airfoil 16 has approximately a 30% reduction in loss due to optimizations of the radial distribution of work across the airfoil.

In an alternate embodiment of the present invention, a turbine is disclosed having a turbine wheel positioned along an engine centerline. The turbine wheel has a plurality of turbine blades 10 secured to the turbine wheel, where each turbine blade 10 has a blade root 12, a platform 14 extending from the blade root 12, and an airfoil 16 extending from the platform. The airfoil has a leading edge 18 and an opposing trailing edge 20. Extending along the airfoil shape between the leading edge 18 and trailing edge 20 is a pressure side surface 22 having a generally concave shape and an opposing suction side surface 24 having a generally convex shape. The airfoil extends to an airfoil tip 26 located opposite the platform 14.

For this embodiment of first stage turbine blades the midpoint of platform 14 lies along a radius from the engine centerline (rotor axis). For purposes of defining the airfoil shape, this location corresponds to a non-dimensional Z value of 0.000. The height of the airfoil 16, as measured from this point, is approximately 7.3 inches.

The airfoil has a nominal uncoated profile substantially in accordance with Cartesian coordinate values of X, Y, and Z as set forth in Table 1 where the Z values are non-dimensional values from 0 to 1 which are convertible to Z distances in inches by multiplying the Z values by a height of the airfoil in inches. The X and Y values are distances in inches which, when connected by smooth continuing arcs, define airfoil profile sections at each distance Z. The profile sections at the Z distances are joined smoothly with one another to form a complete airfoil shape.

In yet another embodiment of the present invention, a turbine, as disclosed above, is provided where the turbine blade 10 secured in the turbine has an airfoil shape lying in an envelope within +/−0.033 inches in a direction normal to any surface location for the blade casting. That is, due to a variety of manufacturing issues such as variations that occur in airfoil casting and machining of turbine blade 10, the exact location of the airfoil shape can vary by up to approximately +/−0.033 inches. However, such variations in the airfoil profile still provide an airfoil fully within the desired performance of a first stage turbine blade that is within the scope of the present invention. This acceptable profile envelope increases to approximately +0.063 to −0.033 inches when accounting for a thermal barrier coating applied to the cast airfoil of up to 0.030 inches thick.

As discussed above, the turbine blade 10, although used within a first stage of a turbine section of a gas turbine engine, is not limited to such function. Instead, the airfoil 16 is scalable such that the airfoil 16 can be utilized in other operating environments. That is, the X, Y, and Z values may be scaled as a function of the same constant number to generate a larger or smaller airfoil, having the same airfoil shape, but for use in a different gas turbine engine. A scaled version of the coordinates in Table 1 would be represented by X, Y, and Z coordinate values of Table 1, with the non-dimensional Z coordinate values converted to inches, and then multiplied or divided by a constant number.

The coordinate values given in Table 1 below provide a nominal profile envelope for the airfoil disclosed herein.

TABLE 1

| X | Y | Z |
|---|---|---|
| 2.781 | −1.643 | 0.000 |
| 2.776 | −1.647 | 0.000 |
| 2.771 | −1.651 | 0.000 |
| 2.766 | −1.655 | 0.000 |
| 2.766 | −1.655 | 0.000 |
| 2.758 | −1.661 | 0.000 |
| 2.753 | −1.663 | 0.000 |
| 2.748 | −1.664 | 0.000 |
| 2.743 | −1.666 | 0.000 |
| 2.737 | −1.666 | 0.000 |
| 2.732 | −1.666 | 0.000 |
| 2.727 | −1.666 | 0.000 |
| 2.722 | −1.665 | 0.000 |
| 2.717 | −1.664 | 0.000 |
| 2.712 | −1.662 | 0.000 |
| 2.707 | −1.659 | 0.000 |
| 2.699 | −1.653 | 0.000 |
| 2.699 | −1.653 | 0.000 |
| 2.617 | −1.578 | 0.000 |
| 2.597 | −1.560 | 0.000 |
| 2.439 | −1.415 | 0.000 |
| 2.436 | −1.412 | 0.000 |
| 2.240 | −1.236 | 0.000 |
| 2.199 | −1.199 | 0.000 |
| 2.093 | −1.110 | 0.000 |
| 1.926 | −0.980 | 0.000 |
| 1.904 | −0.963 | 0.000 |
| 1.857 | −0.928 | 0.000 |
| 1.789 | −0.880 | 0.000 |
| 1.717 | −0.830 | 0.000 |
| 1.562 | −0.728 | 0.000 |
| 1.405 | −0.633 | 0.000 |
| 1.323 | −0.586 | 0.000 |
| 1.066 | −0.453 | 0.000 |
| 0.940 | −0.395 | 0.000 |
| 0.815 | −0.343 | 0.000 |
| 0.566 | −0.255 | 0.000 |
| 0.483 | −0.231 | 0.000 |
| 0.288 | −0.186 | 0.000 |
| 0.099 | −0.160 | 0.000 |
| 0.096 | −0.159 | 0.000 |
| −0.075 | −0.153 | 0.000 |
| −0.329 | −0.178 | 0.000 |
| −0.546 | −0.237 | 0.000 |
| −0.649 | −0.276 | 0.000 |
| −0.838 | −0.368 | 0.000 |
| −1.024 | −0.487 | 0.000 |
| −1.129 | −0.566 | 0.000 |
| −1.259 | −0.680 | 0.000 |
| −1.386 | −0.807 | 0.000 |
| −1.606 | −1.065 | 0.000 |
| −1.606 | −1.065 | 0.000 |
| −1.641 | −1.109 | 0.000 |
| −1.678 | −1.153 | 0.000 |
| −1.716 | −1.195 | 0.000 |
| −1.754 | −1.235 | 0.000 |
| −1.790 | −1.272 | 0.000 |
| −1.826 | −1.306 | 0.000 |
| −1.860 | −1.338 | 0.000 |
| −1.893 | −1.366 | 0.000 |
| −1.924 | −1.392 | 0.000 |
| −1.955 | −1.415 | 0.000 |
| −1.985 | −1.435 | 0.000 |
| −2.015 | −1.453 | 0.000 |
| −2.044 | −1.468 | 0.000 |
| −2.074 | −1.481 | 0.000 |
| −2.104 | −1.489 | 0.000 |
| −2.132 | −1.493 | 0.000 |
| −2.159 | −1.493 | 0.000 |
| −2.184 | −1.489 | 0.000 |
| −2.208 | −1.481 | 0.000 |
| −2.231 | −1.469 | 0.000 |
| −2.254 | −1.454 | 0.000 |
| −2.277 | −1.434 | 0.000 |
| −2.298 | −1.410 | 0.000 |
| −2.316 | −1.384 | 0.000 |
| −2.333 | −1.356 | 0.000 |
| −2.347 | −1.326 | 0.000 |

TABLE 1-continued

| X | Y | Z |
|---|---|---|
| −2.360 | −1.292 | 0.000 |
| −2.372 | −1.254 | 0.000 |
| −2.382 | −1.212 | 0.000 |
| −2.390 | −1.167 | 0.000 |
| −2.396 | −1.121 | 0.000 |
| −2.401 | −1.076 | 0.000 |
| −2.403 | −1.030 | 0.000 |
| −2.404 | −0.984 | 0.000 |
| −2.402 | −0.938 | 0.000 |
| −2.399 | −0.891 | 0.000 |
| −2.394 | −0.844 | 0.000 |
| −2.387 | −0.796 | 0.000 |
| −2.378 | −0.746 | 0.000 |
| −2.365 | −0.693 | 0.000 |
| −2.365 | −0.693 | 0.000 |
| −2.321 | −0.531 | 0.000 |
| −2.269 | −0.373 | 0.000 |
| −2.258 | −0.343 | 0.000 |
| −2.149 | −0.076 | 0.000 |
| −2.061 | 0.100 | 0.000 |
| −2.058 | 0.106 | 0.000 |
| −1.942 | 0.308 | 0.000 |
| −1.834 | 0.470 | 0.000 |
| −1.790 | 0.530 | 0.000 |
| −1.616 | 0.737 | 0.000 |
| −1.527 | 0.825 | 0.000 |
| −1.444 | 0.899 | 0.000 |
| −1.270 | 1.029 | 0.000 |
| −0.858 | 1.222 | 0.000 |
| −0.823 | 1.232 | 0.000 |
| −0.477 | 1.285 | 0.000 |
| −0.205 | 1.266 | 0.000 |
| 0.068 | 1.199 | 0.000 |
| 0.205 | 1.149 | 0.000 |
| 0.315 | 1.100 | 0.000 |
| 0.550 | 0.974 | 0.000 |
| 0.780 | 0.822 | 0.000 |
| 1.237 | 0.439 | 0.000 |
| 1.336 | 0.342 | 0.000 |
| 1.540 | 0.126 | 0.000 |
| 1.739 | −0.103 | 0.000 |
| 1.750 | −0.115 | 0.000 |
| 1.952 | −0.368 | 0.000 |
| 2.116 | −0.589 | 0.000 |
| 2.136 | −0.617 | 0.000 |
| 2.289 | −0.836 | 0.000 |
| 2.407 | −1.012 | 0.000 |
| 2.440 | −1.062 | 0.000 |
| 2.607 | −1.318 | 0.000 |
| 2.633 | −1.359 | 0.000 |
| 2.633 | −1.359 | 0.000 |
| 2.640 | −1.369 | 0.000 |
| 2.646 | −1.380 | 0.000 |
| 2.653 | −1.391 | 0.000 |
| 2.653 | −1.391 | 0.000 |
| 2.693 | −1.459 | 0.000 |
| 2.733 | −1.527 | 0.000 |
| 2.773 | −1.595 | 0.000 |
| 2.773 | −1.595 | 0.000 |
| 2.777 | −1.602 | 0.000 |
| 2.781 | −1.610 | 0.000 |
| 2.783 | −1.617 | 0.000 |
| 2.785 | −1.623 | 0.000 |
| 2.786 | −1.629 | 0.000 |
| 2.786 | −1.635 | 0.000 |
| 2.784 | −1.639 | 0.000 |
| 2.781 | −1.643 | 0.000 |
| 2.733 | −1.665 | 0.100 |
| 2.727 | −1.670 | 0.100 |
| 2.721 | −1.675 | 0.100 |
| 2.715 | −1.680 | 0.100 |
| 2.715 | −1.680 | 0.100 |
| 2.707 | −1.685 | 0.100 |
| 2.703 | −1.687 | 0.100 |
| 2.699 | −1.688 | 0.100 |
| 2.695 | −1.689 | 0.100 |
| 2.691 | −1.690 | 0.100 |
| 2.686 | −1.690 | 0.100 |

TABLE 1-continued

| X | Y | Z |
|---|---|---|
| 2.682 | −1.689 | 0.100 |
| 2.678 | −1.688 | 0.100 |
| 2.674 | −1.687 | 0.100 |
| 2.670 | −1.686 | 0.100 |
| 2.666 | −1.684 | 0.100 |
| 2.659 | −1.678 | 0.100 |
| 2.659 | −1.678 | 0.100 |
| 2.575 | −1.599 | 0.100 |
| 2.555 | −1.581 | 0.100 |
| 2.401 | −1.436 | 0.100 |
| 2.398 | −1.433 | 0.100 |
| 2.209 | −1.258 | 0.100 |
| 2.168 | −1.222 | 0.100 |
| 2.065 | −1.132 | 0.100 |
| 1.903 | −1.001 | 0.100 |
| 1.882 | −0.985 | 0.100 |
| 1.835 | −0.950 | 0.100 |
| 1.768 | −0.901 | 0.100 |
| 1.697 | −0.851 | 0.100 |
| 1.546 | −0.749 | 0.100 |
| 1.394 | −0.653 | 0.100 |
| 1.312 | −0.604 | 0.100 |
| 1.050 | −0.464 | 0.100 |
| 0.924 | −0.403 | 0.100 |
| 0.801 | −0.348 | 0.100 |
| 0.561 | −0.257 | 0.100 |
| 0.480 | −0.231 | 0.100 |
| 0.289 | −0.180 | 0.100 |
| 0.102 | −0.147 | 0.100 |
| 0.098 | −0.146 | 0.100 |
| −0.073 | −0.133 | 0.100 |
| −0.328 | −0.149 | 0.100 |
| −0.546 | −0.197 | 0.100 |
| −0.649 | −0.230 | 0.100 |
| −0.834 | −0.308 | 0.100 |
| −1.018 | −0.413 | 0.100 |
| −1.123 | −0.485 | 0.100 |
| −1.254 | −0.591 | 0.100 |
| −1.385 | −0.714 | 0.100 |
| −1.614 | −0.965 | 0.100 |
| −1.614 | −0.965 | 0.100 |
| −1.649 | −1.006 | 0.100 |
| −1.686 | −1.047 | 0.100 |
| −1.723 | −1.086 | 0.100 |
| −1.759 | −1.123 | 0.100 |
| −1.794 | −1.158 | 0.100 |
| −1.828 | −1.190 | 0.100 |
| −1.861 | −1.219 | 0.100 |
| −1.892 | −1.245 | 0.100 |
| −1.922 | −1.268 | 0.100 |
| −1.951 | −1.290 | 0.100 |
| −1.979 | −1.309 | 0.100 |
| −2.008 | −1.326 | 0.100 |
| −2.036 | −1.340 | 0.100 |
| −2.065 | −1.352 | 0.100 |
| −2.093 | −1.360 | 0.100 |
| −2.120 | −1.365 | 0.100 |
| −2.146 | −1.365 | 0.100 |
| −2.171 | −1.362 | 0.100 |
| −2.195 | −1.355 | 0.100 |
| −2.219 | −1.344 | 0.100 |
| −2.242 | −1.328 | 0.100 |
| −2.265 | −1.309 | 0.100 |
| −2.286 | −1.286 | 0.100 |
| −2.304 | −1.261 | 0.100 |
| −2.320 | −1.233 | 0.100 |
| −2.335 | −1.203 | 0.100 |
| −2.347 | −1.169 | 0.100 |
| −2.358 | −1.133 | 0.100 |
| −2.366 | −1.095 | 0.100 |
| −2.373 | −1.055 | 0.100 |
| −2.378 | −1.013 | 0.100 |
| −2.382 | −0.969 | 0.100 |
| −2.384 | −0.924 | 0.100 |
| −2.384 | −0.879 | 0.100 |
| −2.382 | −0.833 | 0.100 |
| −2.378 | −0.788 | 0.100 |
| −2.373 | −0.742 | 0.100 |

TABLE 1-continued

| X | Y | Z |
|---|---|---|
| −2.365 | −0.695 | 0.100 |
| −2.355 | −0.647 | 0.100 |
| −2.342 | −0.595 | 0.100 |
| −2.342 | −0.595 | 0.100 |
| −2.292 | −0.429 | 0.100 |
| −2.236 | −0.270 | 0.100 |
| −2.224 | −0.240 | 0.100 |
| −2.107 | 0.023 | 0.100 |
| −2.015 | 0.194 | 0.100 |
| −2.011 | 0.200 | 0.100 |
| −1.893 | 0.390 | 0.100 |
| −1.785 | 0.540 | 0.100 |
| −1.741 | 0.595 | 0.100 |
| −1.564 | 0.785 | 0.100 |
| −1.475 | 0.864 | 0.100 |
| −1.394 | 0.928 | 0.100 |
| −1.226 | 1.039 | 0.100 |
| −0.827 | 1.198 | 0.100 |
| −0.792 | 1.206 | 0.100 |
| −0.440 | 1.238 | 0.100 |
| −0.165 | 1.203 | 0.100 |
| 0.103 | 1.124 | 0.100 |
| 0.232 | 1.072 | 0.100 |
| 0.335 | 1.022 | 0.100 |
| 0.558 | 0.893 | 0.100 |
| 0.787 | 0.732 | 0.100 |
| 1.249 | 0.338 | 0.100 |
| 1.343 | 0.245 | 0.100 |
| 1.529 | 0.046 | 0.100 |
| 1.711 | −0.165 | 0.100 |
| 1.721 | −0.177 | 0.100 |
| 1.915 | −0.419 | 0.100 |
| 2.074 | −0.631 | 0.100 |
| 2.094 | −0.658 | 0.100 |
| 2.243 | −0.870 | 0.100 |
| 2.360 | −1.041 | 0.100 |
| 2.393 | −1.089 | 0.100 |
| 2.559 | −1.341 | 0.100 |
| 2.583 | −1.378 | 0.100 |
| 2.583 | −1.378 | 0.100 |
| 2.591 | −1.390 | 0.100 |
| 2.599 | −1.403 | 0.100 |
| 2.606 | −1.415 | 0.100 |
| 2.606 | −1.415 | 0.100 |
| 2.646 | −1.482 | 0.100 |
| 2.685 | −1.549 | 0.100 |
| 2.725 | −1.617 | 0.100 |
| 2.725 | −1.617 | 0.100 |
| 2.729 | −1.624 | 0.100 |
| 2.733 | −1.632 | 0.100 |
| 2.736 | −1.639 | 0.100 |
| 2.737 | −1.645 | 0.100 |
| 2.738 | −1.651 | 0.100 |
| 2.738 | −1.657 | 0.100 |
| 2.736 | −1.661 | 0.100 |
| 2.733 | −1.665 | 0.100 |
| 2.682 | −1.683 | 0.200 |
| 2.674 | −1.690 | 0.200 |
| 2.665 | −1.697 | 0.200 |
| 2.657 | −1.704 | 0.200 |
| 2.657 | −1.704 | 0.200 |
| 2.651 | −1.707 | 0.200 |
| 2.644 | −1.710 | 0.200 |
| 2.638 | −1.710 | 0.200 |
| 2.631 | −1.709 | 0.200 |
| 2.625 | −1.706 | 0.200 |
| 2.619 | −1.702 | 0.200 |
| 2.619 | −1.702 | 0.200 |
| 2.529 | −1.616 | 0.200 |
| 2.509 | −1.598 | 0.200 |
| 2.359 | −1.455 | 0.200 |
| 2.356 | −1.452 | 0.200 |
| 2.173 | −1.279 | 0.200 |
| 2.133 | −1.243 | 0.200 |
| 2.034 | −1.154 | 0.200 |
| 1.880 | −1.025 | 0.200 |
| 1.859 | −1.009 | 0.200 |
| 1.815 | −0.975 | 0.200 |

TABLE 1-continued

| X | Y | Z |
|---|---|---|
| 1.750 | −0.927 | 0.200 |
| 1.682 | −0.877 | 0.200 |
| 1.535 | −0.774 | 0.200 |
| 1.384 | −0.676 | 0.200 |
| 1.303 | −0.626 | 0.200 |
| 1.045 | −0.480 | 0.200 |
| 0.920 | −0.417 | 0.200 |
| 0.796 | −0.358 | 0.200 |
| 0.554 | −0.258 | 0.200 |
| 0.472 | −0.229 | 0.200 |
| 0.283 | −0.172 | 0.200 |
| 0.100 | −0.133 | 0.200 |
| 0.096 | −0.132 | 0.200 |
| −0.073 | −0.113 | 0.200 |
| −0.333 | −0.117 | 0.200 |
| −0.557 | −0.155 | 0.200 |
| −0.662 | −0.184 | 0.200 |
| −0.851 | −0.254 | 0.200 |
| −1.036 | −0.350 | 0.200 |
| −1.138 | −0.416 | 0.200 |
| −1.266 | −0.514 | 0.200 |
| −1.395 | −0.627 | 0.200 |
| −1.622 | −0.862 | 0.200 |
| −1.622 | −0.862 | 0.200 |
| −1.657 | −0.901 | 0.200 |
| −1.694 | −0.939 | 0.200 |
| −1.731 | −0.977 | 0.200 |
| −1.766 | −1.011 | 0.200 |
| −1.800 | −1.042 | 0.200 |
| −1.831 | −1.071 | 0.200 |
| −1.862 | −1.097 | 0.200 |
| −1.894 | −1.123 | 0.200 |
| −1.927 | −1.148 | 0.200 |
| −1.962 | −1.171 | 0.200 |
| −1.996 | −1.192 | 0.200 |
| −2.028 | −1.208 | 0.200 |
| −2.058 | −1.220 | 0.200 |
| −2.085 | −1.228 | 0.200 |
| −2.111 | −1.232 | 0.200 |
| −2.137 | −1.232 | 0.200 |
| −2.163 | −1.229 | 0.200 |
| −2.187 | −1.223 | 0.200 |
| −2.211 | −1.212 | 0.200 |
| −2.234 | −1.197 | 0.200 |
| −2.256 | −1.178 | 0.200 |
| −2.277 | −1.154 | 0.200 |
| −2.296 | −1.126 | 0.200 |
| −2.314 | −1.093 | 0.200 |
| −2.328 | −1.058 | 0.200 |
| −2.341 | −1.019 | 0.200 |
| −2.350 | −0.978 | 0.200 |
| −2.357 | −0.935 | 0.200 |
| −2.362 | −0.893 | 0.200 |
| −2.365 | −0.850 | 0.200 |
| −2.365 | −0.807 | 0.200 |
| −2.364 | −0.763 | 0.200 |
| −2.362 | −0.719 | 0.200 |
| −2.357 | −0.675 | 0.200 |
| −2.351 | −0.630 | 0.200 |
| −2.342 | −0.585 | 0.200 |
| −2.332 | −0.538 | 0.200 |
| −2.318 | −0.488 | 0.200 |
| −2.318 | −0.488 | 0.200 |
| −2.264 | −0.321 | 0.200 |
| −2.203 | −0.164 | 0.200 |
| −2.191 | −0.134 | 0.200 |
| −2.067 | 0.121 | 0.200 |
| −1.971 | 0.285 | 0.200 |
| −1.968 | 0.290 | 0.200 |
| −1.848 | 0.468 | 0.200 |
| −1.740 | 0.606 | 0.200 |
| −1.695 | 0.656 | 0.200 |
| −1.515 | 0.831 | 0.200 |
| −1.426 | 0.901 | 0.200 |
| −1.343 | 0.958 | 0.200 |
| −1.174 | 1.054 | 0.200 |
| −0.780 | 1.179 | 0.200 |
| −0.745 | 1.184 | 0.200 |

TABLE 1-continued

| X | Y | Z |
|---|---|---|
| −0.399 | 1.190 | 0.200 |
| −0.131 | 1.142 | 0.200 |
| 0.126 | 1.054 | 0.200 |
| 0.250 | 0.998 | 0.200 |
| 0.349 | 0.946 | 0.200 |
| 0.564 | 0.814 | 0.200 |
| 0.783 | 0.655 | 0.200 |
| 1.225 | 0.272 | 0.200 |
| 1.318 | 0.180 | 0.200 |
| 1.501 | −0.017 | 0.200 |
| 1.681 | −0.226 | 0.200 |
| 1.690 | −0.237 | 0.200 |
| 1.879 | −0.472 | 0.200 |
| 2.033 | −0.675 | 0.200 |
| 2.052 | −0.700 | 0.200 |
| 2.199 | −0.907 | 0.200 |
| 2.315 | −1.074 | 0.200 |
| 2.348 | −1.121 | 0.200 |
| 2.512 | −1.366 | 0.200 |
| 2.530 | −1.393 | 0.200 |
| 2.530 | −1.393 | 0.200 |
| 2.539 | −1.407 | 0.200 |
| 2.548 | −1.421 | 0.200 |
| 2.557 | −1.436 | 0.200 |
| 2.557 | −1.436 | 0.200 |
| 2.596 | −1.502 | 0.200 |
| 2.635 | −1.568 | 0.200 |
| 2.674 | −1.634 | 0.200 |
| 2.674 | −1.634 | 0.200 |
| 2.678 | −1.642 | 0.200 |
| 2.682 | −1.649 | 0.200 |
| 2.685 | −1.656 | 0.200 |
| 2.687 | −1.663 | 0.200 |
| 2.687 | −1.669 | 0.200 |
| 2.687 | −1.674 | 0.200 |
| 2.685 | −1.679 | 0.200 |
| 2.682 | −1.683 | 0.200 |
| 2.628 | −1.696 | 0.300 |
| 2.618 | −1.705 | 0.300 |
| 2.607 | −1.713 | 0.300 |
| 2.597 | −1.722 | 0.300 |
| 2.597 | −1.722 | 0.300 |
| 2.595 | −1.724 | 0.300 |
| 2.593 | −1.725 | 0.300 |
| 2.590 | −1.725 | 0.300 |
| 2.588 | −1.726 | 0.300 |
| 2.586 | −1.726 | 0.300 |
| 2.584 | −1.726 | 0.300 |
| 2.581 | −1.725 | 0.300 |
| 2.579 | −1.724 | 0.300 |
| 2.577 | −1.723 | 0.300 |
| 2.576 | −1.721 | 0.300 |
| 2.576 | −1.721 | 0.300 |
| 2.480 | −1.629 | 0.300 |
| 2.461 | −1.611 | 0.300 |
| 2.314 | −1.470 | 0.300 |
| 2.311 | −1.467 | 0.300 |
| 2.132 | −1.296 | 0.300 |
| 2.094 | −1.260 | 0.300 |
| 1.998 | −1.173 | 0.300 |
| 1.850 | −1.047 | 0.300 |
| 1.831 | −1.031 | 0.300 |
| 1.788 | −0.997 | 0.300 |
| 1.727 | −0.950 | 0.300 |
| 1.662 | −0.902 | 0.300 |
| 1.519 | −0.799 | 0.300 |
| 1.370 | −0.698 | 0.300 |
| 1.289 | −0.646 | 0.300 |
| 1.039 | −0.498 | 0.300 |
| 0.917 | −0.432 | 0.300 |
| 0.794 | −0.370 | 0.300 |
| 0.547 | −0.260 | 0.300 |
| 0.464 | −0.227 | 0.300 |
| 0.274 | −0.163 | 0.300 |
| 0.094 | −0.117 | 0.300 |
| 0.091 | −0.116 | 0.300 |
| −0.078 | −0.090 | 0.300 |
| −0.342 | −0.083 | 0.300 |

TABLE 1-continued

| X | Y | Z |
|---|---|---|
| −0.573 | −0.111 | 0.300 |
| −0.682 | −0.136 | 0.300 |
| −0.877 | −0.200 | 0.300 |
| −1.062 | −0.287 | 0.300 |
| −1.162 | −0.348 | 0.300 |
| −1.284 | −0.437 | 0.300 |
| −1.408 | −0.540 | 0.300 |
| −1.629 | −0.754 | 0.300 |
| −1.629 | −0.754 | 0.300 |
| −1.664 | −0.790 | 0.300 |
| −1.700 | −0.826 | 0.300 |
| −1.736 | −0.861 | 0.300 |
| −1.771 | −0.894 | 0.300 |
| −1.804 | −0.923 | 0.300 |
| −1.835 | −0.950 | 0.300 |
| −1.866 | −0.975 | 0.300 |
| −1.896 | −0.999 | 0.300 |
| −1.929 | −1.022 | 0.300 |
| −1.963 | −1.043 | 0.300 |
| −1.997 | −1.063 | 0.300 |
| −2.030 | −1.078 | 0.300 |
| −2.061 | −1.089 | 0.300 |
| −2.090 | −1.095 | 0.300 |
| −2.118 | −1.098 | 0.300 |
| −2.145 | −1.096 | 0.300 |
| −2.172 | −1.090 | 0.300 |
| −2.197 | −1.080 | 0.300 |
| −2.221 | −1.066 | 0.300 |
| −2.243 | −1.048 | 0.300 |
| −2.263 | −1.026 | 0.300 |
| −2.281 | −1.000 | 0.300 |
| −2.298 | −0.970 | 0.300 |
| −2.312 | −0.937 | 0.300 |
| −2.324 | −0.902 | 0.300 |
| −2.333 | −0.867 | 0.300 |
| −2.340 | −0.831 | 0.300 |
| −2.345 | −0.793 | 0.300 |
| −2.347 | −0.754 | 0.300 |
| −2.348 | −0.712 | 0.300 |
| −2.347 | −0.667 | 0.300 |
| −2.344 | −0.619 | 0.300 |
| −2.339 | −0.571 | 0.300 |
| −2.331 | −0.521 | 0.300 |
| −2.321 | −0.472 | 0.300 |
| −2.309 | −0.423 | 0.300 |
| −2.294 | −0.374 | 0.300 |
| −2.294 | −0.374 | 0.300 |
| −2.237 | −0.211 | 0.300 |
| −2.173 | −0.059 | 0.300 |
| −2.160 | −0.030 | 0.300 |
| −2.030 | 0.215 | 0.300 |
| −1.933 | 0.370 | 0.300 |
| −1.929 | 0.375 | 0.300 |
| −1.807 | 0.542 | 0.300 |
| −1.696 | 0.670 | 0.300 |
| −1.651 | 0.716 | 0.300 |
| −1.467 | 0.874 | 0.300 |
| −1.375 | 0.938 | 0.300 |
| −1.290 | 0.988 | 0.300 |
| −1.116 | 1.070 | 0.300 |
| −0.725 | 1.161 | 0.300 |
| −0.692 | 1.163 | 0.300 |
| −0.358 | 1.144 | 0.300 |
| −0.103 | 1.084 | 0.300 |
| 0.142 | 0.988 | 0.300 |
| 0.263 | 0.928 | 0.300 |
| 0.361 | 0.873 | 0.300 |
| 0.569 | 0.738 | 0.300 |
| 0.775 | 0.585 | 0.300 |
| 1.189 | 0.220 | 0.300 |
| 1.279 | 0.129 | 0.300 |
| 1.466 | −0.071 | 0.300 |
| 1.649 | −0.282 | 0.300 |
| 1.658 | −0.293 | 0.300 |
| 1.843 | −0.522 | 0.300 |
| 1.992 | −0.717 | 0.300 |
| 2.010 | −0.742 | 0.300 |
| 2.155 | −0.942 | 0.300 |

TABLE 1-continued

| X | Y | Z |
|---|---|---|
| 2.270 | −1.105 | 0.300 |
| 2.302 | −1.152 | 0.300 |
| 2.464 | −1.389 | 0.300 |
| 2.474 | −1.403 | 0.300 |
| 2.474 | −1.403 | 0.300 |
| 2.484 | −1.419 | 0.300 |
| 2.495 | −1.435 | 0.300 |
| 2.505 | −1.452 | 0.300 |
| 2.505 | −1.452 | 0.300 |
| 2.543 | −1.517 | 0.300 |
| 2.582 | −1.582 | 0.300 |
| 2.620 | −1.647 | 0.300 |
| 2.620 | −1.647 | 0.300 |
| 2.625 | −1.655 | 0.300 |
| 2.628 | −1.663 | 0.300 |
| 2.631 | −1.669 | 0.300 |
| 2.633 | −1.676 | 0.300 |
| 2.634 | −1.682 | 0.300 |
| 2.633 | −1.687 | 0.300 |
| 2.632 | −1.692 | 0.300 |
| 2.628 | −1.696 | 0.300 |
| 2.572 | −1.704 | 0.400 |
| 2.561 | −1.713 | 0.400 |
| 2.549 | −1.723 | 0.400 |
| 2.538 | −1.732 | 0.400 |
| 2.538 | −1.732 | 0.400 |
| 2.537 | −1.733 | 0.400 |
| 2.535 | −1.734 | 0.400 |
| 2.534 | −1.734 | 0.400 |
| 2.532 | −1.734 | 0.400 |
| 2.531 | −1.734 | 0.400 |
| 2.530 | −1.734 | 0.400 |
| 2.528 | −1.734 | 0.400 |
| 2.527 | −1.733 | 0.400 |
| 2.526 | −1.733 | 0.400 |
| 2.524 | −1.732 | 0.400 |
| 2.524 | −1.732 | 0.400 |
| 2.427 | −1.637 | 0.400 |
| 2.408 | −1.619 | 0.400 |
| 2.263 | −1.480 | 0.400 |
| 2.260 | −1.477 | 0.400 |
| 2.084 | −1.307 | 0.400 |
| 2.046 | −1.271 | 0.400 |
| 1.951 | −1.184 | 0.400 |
| 1.806 | −1.058 | 0.400 |
| 1.787 | −1.042 | 0.400 |
| 1.745 | −1.008 | 0.400 |
| 1.685 | −0.961 | 0.400 |
| 1.621 | −0.912 | 0.400 |
| 1.482 | −0.810 | 0.400 |
| 1.338 | −0.710 | 0.400 |
| 1.261 | −0.659 | 0.400 |
| 1.018 | −0.508 | 0.400 |
| 0.901 | −0.441 | 0.400 |
| 0.782 | −0.378 | 0.400 |
| 0.542 | −0.262 | 0.400 |
| 0.460 | −0.227 | 0.400 |
| 0.269 | −0.154 | 0.400 |
| 0.085 | −0.100 | 0.400 |
| 0.082 | −0.099 | 0.400 |
| −0.089 | −0.065 | 0.400 |
| −0.353 | −0.045 | 0.400 |
| −0.586 | −0.061 | 0.400 |
| −0.696 | −0.081 | 0.400 |
| −0.891 | −0.134 | 0.400 |
| −1.074 | −0.211 | 0.400 |
| −1.172 | −0.266 | 0.400 |
| −1.292 | −0.346 | 0.400 |
| −1.415 | −0.441 | 0.400 |
| −1.636 | −0.643 | 0.400 |
| −1.636 | −0.643 | 0.400 |
| −1.669 | −0.676 | 0.400 |
| −1.702 | −0.707 | 0.400 |
| −1.734 | −0.737 | 0.400 |
| −1.767 | −0.766 | 0.400 |
| −1.799 | −0.794 | 0.400 |
| −1.833 | −0.822 | 0.400 |
| −1.868 | −0.849 | 0.400 |

TABLE 1-continued

| X | Y | Z |
|---|---|---|
| −1.901 | −0.873 | 0.400 |
| −1.932 | −0.893 | 0.400 |
| −1.960 | −0.910 | 0.400 |
| −1.988 | −0.925 | 0.400 |
| −2.015 | −0.937 | 0.400 |
| −2.042 | −0.947 | 0.400 |
| −2.069 | −0.954 | 0.400 |
| −2.095 | −0.958 | 0.400 |
| −2.120 | −0.959 | 0.400 |
| −2.144 | −0.957 | 0.400 |
| −2.166 | −0.951 | 0.400 |
| −2.188 | −0.942 | 0.400 |
| −2.209 | −0.930 | 0.400 |
| −2.228 | −0.915 | 0.400 |
| −2.246 | −0.896 | 0.400 |
| −2.264 | −0.873 | 0.400 |
| −2.282 | −0.844 | 0.400 |
| −2.298 | −0.809 | 0.400 |
| −2.311 | −0.768 | 0.400 |
| −2.321 | −0.725 | 0.400 |
| −2.328 | −0.681 | 0.400 |
| −2.331 | −0.637 | 0.400 |
| −2.332 | −0.594 | 0.400 |
| −2.330 | −0.552 | 0.400 |
| −2.327 | −0.510 | 0.400 |
| −2.322 | −0.469 | 0.400 |
| −2.316 | −0.427 | 0.400 |
| −2.307 | −0.386 | 0.400 |
| −2.297 | −0.344 | 0.400 |
| −2.284 | −0.300 | 0.400 |
| −2.269 | −0.255 | 0.400 |
| −2.269 | −0.255 | 0.400 |
| −2.211 | −0.103 | 0.400 |
| −2.145 | 0.041 | 0.400 |
| −2.132 | 0.068 | 0.400 |
| −2.000 | 0.301 | 0.400 |
| −1.899 | 0.449 | 0.400 |
| −1.895 | 0.454 | 0.400 |
| −1.766 | 0.615 | 0.400 |
| −1.650 | 0.735 | 0.400 |
| −1.602 | 0.778 | 0.400 |
| −1.413 | 0.919 | 0.400 |
| −1.319 | 0.974 | 0.400 |
| −1.232 | 1.016 | 0.400 |
| −1.058 | 1.083 | 0.400 |
| −0.675 | 1.141 | 0.400 |
| −0.643 | 1.141 | 0.400 |
| −0.325 | 1.101 | 0.400 |
| −0.080 | 1.030 | 0.400 |
| 0.159 | 0.925 | 0.400 |
| 0.277 | 0.861 | 0.400 |
| 0.373 | 0.804 | 0.400 |
| 0.574 | 0.667 | 0.400 |
| 0.772 | 0.515 | 0.400 |
| 1.169 | 0.158 | 0.400 |
| 1.256 | 0.069 | 0.400 |
| 1.437 | −0.126 | 0.400 |
| 1.614 | −0.331 | 0.400 |
| 1.624 | −0.342 | 0.400 |
| 1.804 | −0.564 | 0.400 |
| 1.950 | −0.755 | 0.400 |
| 1.967 | −0.778 | 0.400 |
| 2.108 | −0.971 | 0.400 |
| 2.220 | −1.128 | 0.400 |
| 2.251 | −1.172 | 0.400 |
| 2.412 | −1.403 | 0.400 |
| 2.415 | −1.408 | 0.400 |
| 2.415 | −1.408 | 0.400 |
| 2.427 | −1.426 | 0.400 |
| 2.438 | −1.444 | 0.400 |
| 2.449 | −1.462 | 0.400 |
| 2.449 | −1.462 | 0.400 |
| 2.487 | −1.526 | 0.400 |
| 2.526 | −1.591 | 0.400 |
| 2.564 | −1.655 | 0.400 |
| 2.564 | −1.655 | 0.400 |
| 2.569 | −1.663 | 0.400 |
| 2.572 | −1.670 | 0.400 |

TABLE 1-continued

| X | Y | Z |
|---|---|---|
| 2.575 | −1.677 | 0.400 |
| 2.577 | −1.684 | 0.400 |
| 2.578 | −1.690 | 0.400 |
| 2.577 | −1.695 | 0.400 |
| 2.575 | −1.700 | 0.400 |
| 2.572 | −1.704 | 0.400 |
| 2.513 | −1.706 | 0.500 |
| 2.502 | −1.715 | 0.500 |
| 2.491 | −1.725 | 0.500 |
| 2.480 | −1.734 | 0.500 |
| 2.480 | −1.734 | 0.500 |
| 2.479 | −1.735 | 0.500 |
| 2.477 | −1.736 | 0.500 |
| 2.476 | −1.736 | 0.500 |
| 2.474 | −1.736 | 0.500 |
| 2.473 | −1.736 | 0.500 |
| 2.472 | −1.736 | 0.500 |
| 2.470 | −1.736 | 0.500 |
| 2.469 | −1.735 | 0.500 |
| 2.468 | −1.734 | 0.500 |
| 2.466 | −1.734 | 0.500 |
| 2.466 | −1.734 | 0.500 |
| 2.369 | −1.640 | 0.500 |
| 2.350 | −1.622 | 0.500 |
| 2.207 | −1.483 | 0.500 |
| 2.204 | −1.480 | 0.500 |
| 2.027 | −1.310 | 0.500 |
| 1.989 | −1.274 | 0.500 |
| 1.894 | −1.186 | 0.500 |
| 1.749 | −1.059 | 0.500 |
| 1.729 | −1.043 | 0.500 |
| 1.687 | −1.009 | 0.500 |
| 1.627 | −0.961 | 0.500 |
| 1.563 | −0.911 | 0.500 |
| 1.426 | −0.809 | 0.500 |
| 1.288 | −0.711 | 0.500 |
| 1.214 | −0.660 | 0.500 |
| 0.981 | −0.509 | 0.500 |
| 0.868 | −0.441 | 0.500 |
| 0.754 | −0.377 | 0.500 |
| 0.524 | −0.258 | 0.500 |
| 0.445 | −0.221 | 0.500 |
| 0.257 | −0.143 | 0.500 |
| 0.072 | −0.081 | 0.500 |
| 0.069 | −0.080 | 0.500 |
| −0.101 | −0.038 | 0.500 |
| −0.358 | −0.004 | 0.500 |
| −0.583 | −0.007 | 0.500 |
| −0.691 | −0.018 | 0.500 |
| −0.882 | −0.058 | 0.500 |
| −1.063 | −0.122 | 0.500 |
| −1.162 | −0.170 | 0.500 |
| −1.287 | −0.244 | 0.500 |
| −1.413 | −0.333 | 0.500 |
| −1.640 | −0.527 | 0.500 |
| −1.640 | −0.527 | 0.500 |
| −1.672 | −0.557 | 0.500 |
| −1.703 | −0.585 | 0.500 |
| −1.734 | −0.612 | 0.500 |
| −1.765 | −0.638 | 0.500 |
| −1.797 | −0.664 | 0.500 |
| −1.829 | −0.689 | 0.500 |
| −1.862 | −0.713 | 0.500 |
| −1.895 | −0.735 | 0.500 |
| −1.925 | −0.753 | 0.500 |
| −1.953 | −0.769 | 0.500 |
| −1.981 | −0.782 | 0.500 |
| −2.007 | −0.793 | 0.500 |
| −2.034 | −0.802 | 0.500 |
| −2.060 | −0.809 | 0.500 |
| −2.085 | −0.814 | 0.500 |
| −2.110 | −0.815 | 0.500 |
| −2.133 | −0.814 | 0.500 |
| −2.155 | −0.809 | 0.500 |
| −2.175 | −0.802 | 0.500 |
| −2.195 | −0.790 | 0.500 |
| −2.214 | −0.776 | 0.500 |
| −2.232 | −0.758 | 0.500 |

TABLE 1-continued

| X | Y | Z |
|---|---|---|
| −2.249 | −0.738 | 0.500 |
| −2.264 | −0.715 | 0.500 |
| −2.277 | −0.689 | 0.500 |
| −2.288 | −0.662 | 0.500 |
| −2.297 | −0.632 | 0.500 |
| −2.305 | −0.600 | 0.500 |
| −2.310 | −0.565 | 0.500 |
| −2.313 | −0.528 | 0.500 |
| −2.314 | −0.490 | 0.500 |
| −2.314 | −0.450 | 0.500 |
| −2.311 | −0.411 | 0.500 |
| −2.307 | −0.371 | 0.500 |
| −2.300 | −0.331 | 0.500 |
| −2.293 | −0.292 | 0.500 |
| −2.283 | −0.252 | 0.500 |
| −2.272 | −0.212 | 0.500 |
| −2.259 | −0.171 | 0.500 |
| −2.243 | −0.129 | 0.500 |
| −2.243 | −0.129 | 0.500 |
| −2.181 | 0.015 | 0.500 |
| −2.113 | 0.152 | 0.500 |
| −2.099 | 0.177 | 0.500 |
| −1.961 | 0.399 | 0.500 |
| −1.854 | 0.540 | 0.500 |
| −1.851 | 0.544 | 0.500 |
| −1.714 | 0.695 | 0.500 |
| −1.593 | 0.805 | 0.500 |
| −1.545 | 0.842 | 0.500 |
| −1.351 | 0.964 | 0.500 |
| −1.257 | 1.009 | 0.500 |
| −1.171 | 1.043 | 0.500 |
| −0.998 | 1.093 | 0.500 |
| −0.624 | 1.119 | 0.500 |
| −0.593 | 1.117 | 0.500 |
| −0.290 | 1.061 | 0.500 |
| −0.056 | 0.980 | 0.500 |
| 0.177 | 0.867 | 0.500 |
| 0.292 | 0.800 | 0.500 |
| 0.384 | 0.741 | 0.500 |
| 0.579 | 0.603 | 0.500 |
| 0.770 | 0.451 | 0.500 |
| 1.155 | 0.097 | 0.500 |
| 1.239 | 0.011 | 0.500 |
| 1.411 | −0.176 | 0.500 |
| 1.579 | −0.372 | 0.500 |
| 1.588 | −0.383 | 0.500 |
| 1.762 | −0.598 | 0.500 |
| 1.905 | −0.783 | 0.500 |
| 1.922 | −0.806 | 0.500 |
| 2.059 | −0.992 | 0.500 |
| 2.167 | −1.143 | 0.500 |
| 2.198 | −1.187 | 0.500 |
| 2.355 | −1.410 | 0.500 |
| 2.355 | −1.410 | 0.500 |
| 2.367 | −1.428 | 0.500 |
| 2.379 | −1.447 | 0.500 |
| 2.391 | −1.466 | 0.500 |
| 2.391 | −1.466 | 0.500 |
| 2.429 | −1.529 | 0.500 |
| 2.467 | −1.594 | 0.500 |
| 2.505 | −1.658 | 0.500 |
| 2.505 | −1.658 | 0.500 |
| 2.510 | −1.665 | 0.500 |
| 2.513 | −1.673 | 0.500 |
| 2.516 | −1.680 | 0.500 |
| 2.518 | −1.686 | 0.500 |
| 2.519 | −1.692 | 0.500 |
| 2.518 | −1.698 | 0.500 |
| 2.517 | −1.702 | 0.500 |
| 2.513 | −1.706 | 0.500 |
| 2.452 | −1.703 | 0.600 |
| 2.441 | −1.712 | 0.600 |
| 2.430 | −1.722 | 0.600 |
| 2.418 | −1.731 | 0.600 |
| 2.418 | −1.731 | 0.600 |
| 2.417 | −1.732 | 0.600 |
| 2.416 | −1.733 | 0.600 |
| 2.415 | −1.733 | 0.600 |

TABLE 1-continued

| X | Y | Z |
|---|---|---|
| 2.413 | −1.733 | 0.600 |
| 2.412 | −1.733 | 0.600 |
| 2.410 | −1.733 | 0.600 |
| 2.409 | −1.733 | 0.600 |
| 2.407 | −1.732 | 0.600 |
| 2.406 | −1.732 | 0.600 |
| 2.405 | −1.731 | 0.600 |
| 2.405 | −1.731 | 0.600 |
| 2.307 | −1.637 | 0.600 |
| 2.288 | −1.619 | 0.600 |
| 2.144 | −1.481 | 0.600 |
| 2.141 | −1.478 | 0.600 |
| 1.962 | −1.307 | 0.600 |
| 1.924 | −1.271 | 0.600 |
| 1.829 | −1.183 | 0.600 |
| 1.683 | −1.056 | 0.600 |
| 1.664 | −1.039 | 0.600 |
| 1.622 | −1.005 | 0.600 |
| 1.561 | −0.956 | 0.600 |
| 1.497 | −0.906 | 0.600 |
| 1.361 | −0.802 | 0.600 |
| 1.225 | −0.703 | 0.600 |
| 1.153 | −0.652 | 0.600 |
| 0.928 | −0.501 | 0.600 |
| 0.818 | −0.432 | 0.600 |
| 0.708 | −0.366 | 0.600 |
| 0.486 | −0.245 | 0.600 |
| 0.410 | −0.207 | 0.600 |
| 0.232 | −0.127 | 0.600 |
| 0.056 | −0.061 | 0.600 |
| 0.053 | −0.060 | 0.600 |
| −0.109 | −0.011 | 0.600 |
| −0.354 | 0.037 | 0.600 |
| −0.569 | 0.050 | 0.600 |
| −0.671 | 0.046 | 0.600 |
| −0.857 | 0.022 | 0.600 |
| −1.042 | −0.029 | 0.600 |
| −1.147 | −0.071 | 0.600 |
| −1.279 | −0.138 | 0.600 |
| −1.410 | −0.221 | 0.600 |
| −1.641 | −0.404 | 0.600 |
| −1.641 | −0.404 | 0.600 |
| −1.658 | −0.419 | 0.600 |
| −1.675 | −0.434 | 0.600 |
| −1.692 | −0.449 | 0.600 |
| −1.710 | −0.464 | 0.600 |
| −1.728 | −0.479 | 0.600 |
| −1.749 | −0.495 | 0.600 |
| −1.772 | −0.514 | 0.600 |
| −1.799 | −0.534 | 0.600 |
| −1.828 | −0.554 | 0.600 |
| −1.859 | −0.574 | 0.600 |
| −1.890 | −0.593 | 0.600 |
| −1.920 | −0.610 | 0.600 |
| −1.950 | −0.626 | 0.600 |
| −1.980 | −0.639 | 0.600 |
| −2.008 | −0.649 | 0.600 |
| −2.037 | −0.658 | 0.600 |
| −2.064 | −0.663 | 0.600 |
| −2.091 | −0.667 | 0.600 |
| −2.117 | −0.667 | 0.600 |
| −2.140 | −0.664 | 0.600 |
| −2.162 | −0.657 | 0.600 |
| −2.182 | −0.648 | 0.600 |
| −2.201 | −0.635 | 0.600 |
| −2.219 | −0.618 | 0.600 |
| −2.236 | −0.597 | 0.600 |
| −2.251 | −0.574 | 0.600 |
| −2.264 | −0.549 | 0.600 |
| −2.275 | −0.522 | 0.600 |
| −2.283 | −0.493 | 0.600 |
| −2.290 | −0.462 | 0.600 |
| −2.295 | −0.430 | 0.600 |
| −2.297 | −0.397 | 0.600 |
| −2.298 | −0.362 | 0.600 |
| −2.297 | −0.326 | 0.600 |
| −2.294 | −0.288 | 0.600 |
| −2.289 | −0.248 | 0.600 |

TABLE 1-continued

| X | Y | Z |
|---|---|---|
| −2.282 | −0.206 | 0.600 |
| −2.273 | −0.163 | 0.600 |
| −2.262 | −0.121 | 0.600 |
| −2.248 | −0.079 | 0.600 |
| −2.233 | −0.037 | 0.600 |
| −2.216 | 0.003 | 0.600 |
| −2.216 | 0.003 | 0.600 |
| −2.147 | 0.147 | 0.600 |
| −2.073 | 0.281 | 0.600 |
| −2.058 | 0.306 | 0.600 |
| −1.908 | 0.519 | 0.600 |
| −1.795 | 0.650 | 0.600 |
| −1.791 | 0.654 | 0.600 |
| −1.651 | 0.787 | 0.600 |
| −1.529 | 0.879 | 0.600 |
| −1.480 | 0.911 | 0.600 |
| −1.287 | 1.008 | 0.600 |
| −1.193 | 1.043 | 0.600 |
| −1.108 | 1.068 | 0.600 |
| −0.938 | 1.101 | 0.600 |
| −0.572 | 1.098 | 0.600 |
| −0.542 | 1.093 | 0.600 |
| −0.251 | 1.021 | 0.600 |
| −0.030 | 0.931 | 0.600 |
| 0.191 | 0.814 | 0.600 |
| 0.302 | 0.745 | 0.600 |
| 0.391 | 0.686 | 0.600 |
| 0.578 | 0.548 | 0.600 |
| 0.761 | 0.399 | 0.600 |
| 1.130 | 0.052 | 0.600 |
| 1.211 | −0.033 | 0.600 |
| 1.379 | −0.217 | 0.600 |
| 1.544 | −0.409 | 0.600 |
| 1.552 | −0.419 | 0.600 |
| 1.721 | −0.627 | 0.600 |
| 1.859 | −0.807 | 0.600 |
| 1.876 | −0.829 | 0.600 |
| 2.009 | −1.010 | 0.600 |
| 2.116 | −1.158 | 0.600 |
| 2.146 | −1.200 | 0.600 |
| 2.292 | −1.408 | 0.600 |
| 2.292 | −1.408 | 0.600 |
| 2.305 | −1.425 | 0.600 |
| 2.316 | −1.444 | 0.600 |
| 2.328 | −1.462 | 0.600 |
| 2.328 | −1.462 | 0.600 |
| 2.366 | −1.526 | 0.600 |
| 2.405 | −1.590 | 0.600 |
| 2.444 | −1.654 | 0.600 |
| 2.444 | −1.654 | 0.600 |
| 2.448 | −1.662 | 0.600 |
| 2.452 | −1.670 | 0.600 |
| 2.455 | −1.676 | 0.600 |
| 2.457 | −1.683 | 0.600 |
| 2.457 | −1.689 | 0.600 |
| 2.457 | −1.694 | 0.600 |
| 2.455 | −1.699 | 0.600 |
| 2.452 | −1.703 | 0.600 |
| 2.388 | −1.695 | 0.700 |
| 2.377 | −1.705 | 0.700 |
| 2.365 | −1.714 | 0.700 |
| 2.354 | −1.724 | 0.700 |
| 2.354 | −1.724 | 0.700 |
| 2.353 | −1.725 | 0.700 |
| 2.352 | −1.725 | 0.700 |
| 2.350 | −1.726 | 0.700 |
| 2.349 | −1.726 | 0.700 |
| 2.347 | −1.726 | 0.700 |
| 2.346 | −1.726 | 0.700 |
| 2.345 | −1.726 | 0.700 |
| 2.343 | −1.725 | 0.700 |
| 2.342 | −1.724 | 0.700 |
| 2.341 | −1.724 | 0.700 |
| 2.341 | −1.724 | 0.700 |
| 2.241 | −1.630 | 0.700 |
| 2.222 | −1.612 | 0.700 |
| 2.076 | −1.475 | 0.700 |
| 2.072 | −1.472 | 0.700 |

TABLE 1-continued

| X | Y | Z |
|---|---|---|
| 1.893 | −1.302 | 0.700 |
| 1.854 | −1.267 | 0.700 |
| 1.759 | −1.179 | 0.700 |
| 1.612 | −1.052 | 0.700 |
| 1.593 | −1.036 | 0.700 |
| 1.551 | −1.001 | 0.700 |
| 1.491 | −0.952 | 0.700 |
| 1.427 | −0.902 | 0.700 |
| 1.291 | −0.796 | 0.700 |
| 1.155 | −0.695 | 0.700 |
| 1.084 | −0.643 | 0.700 |
| 0.865 | −0.490 | 0.700 |
| 0.759 | −0.421 | 0.700 |
| 0.652 | −0.354 | 0.700 |
| 0.441 | −0.231 | 0.700 |
| 0.369 | −0.193 | 0.700 |
| 0.201 | −0.110 | 0.700 |
| 0.036 | −0.040 | 0.700 |
| 0.034 | −0.039 | 0.700 |
| −0.121 | 0.016 | 0.700 |
| −0.357 | 0.077 | 0.700 |
| −0.567 | 0.105 | 0.700 |
| −0.668 | 0.109 | 0.700 |
| −0.857 | 0.096 | 0.700 |
| −1.046 | 0.056 | 0.700 |
| −1.152 | 0.020 | 0.700 |
| −1.285 | −0.039 | 0.700 |
| −1.417 | −0.113 | 0.700 |
| −1.644 | −0.279 | 0.700 |
| −1.644 | −0.279 | 0.700 |
| −1.678 | −0.307 | 0.700 |
| −1.711 | −0.333 | 0.700 |
| −1.743 | −0.358 | 0.700 |
| −1.777 | −0.382 | 0.700 |
| −1.811 | −0.405 | 0.700 |
| −1.846 | −0.427 | 0.700 |
| −1.882 | −0.448 | 0.700 |
| −1.916 | −0.466 | 0.700 |
| −1.948 | −0.481 | 0.700 |
| −1.979 | −0.492 | 0.700 |
| −2.007 | −0.502 | 0.700 |
| −2.035 | −0.509 | 0.700 |
| −2.063 | −0.514 | 0.700 |
| −2.090 | −0.516 | 0.700 |
| −2.116 | −0.515 | 0.700 |
| −2.139 | −0.511 | 0.700 |
| −2.160 | −0.504 | 0.700 |
| −2.180 | −0.494 | 0.700 |
| −2.197 | −0.480 | 0.700 |
| −2.213 | −0.464 | 0.700 |
| −2.229 | −0.444 | 0.700 |
| −2.242 | −0.422 | 0.700 |
| −2.254 | −0.397 | 0.700 |
| −2.263 | −0.372 | 0.700 |
| −2.271 | −0.345 | 0.700 |
| −2.277 | −0.316 | 0.700 |
| −2.281 | −0.284 | 0.700 |
| −2.283 | −0.249 | 0.700 |
| −2.283 | −0.208 | 0.700 |
| −2.280 | −0.163 | 0.700 |
| −2.273 | −0.113 | 0.700 |
| −2.263 | −0.058 | 0.700 |
| −2.247 | 0.003 | 0.700 |
| −2.224 | 0.070 | 0.700 |
| −2.192 | 0.143 | 0.700 |
| −2.192 | 0.143 | 0.700 |
| −2.119 | 0.284 | 0.700 |
| −2.040 | 0.413 | 0.700 |
| −2.024 | 0.437 | 0.700 |
| −1.865 | 0.639 | 0.700 |
| −1.745 | 0.758 | 0.700 |
| −1.741 | 0.761 | 0.700 |
| −1.597 | 0.877 | 0.700 |
| −1.472 | 0.955 | 0.700 |
| −1.423 | 0.980 | 0.700 |
| −1.230 | 1.054 | 0.700 |
| −1.137 | 1.078 | 0.700 |
| −1.052 | 1.093 | 0.700 |

TABLE 1-continued

| X | Y | Z |
|---|---|---|
| −0.885 | 1.108 | 0.700 |
| −0.531 | 1.074 | 0.700 |
| −0.502 | 1.068 | 0.700 |
| −0.224 | 0.978 | 0.700 |
| −0.014 | 0.881 | 0.700 |
| 0.195 | 0.760 | 0.700 |
| 0.300 | 0.691 | 0.700 |
| 0.384 | 0.632 | 0.700 |
| 0.563 | 0.496 | 0.700 |
| 0.739 | 0.349 | 0.700 |
| 1.096 | 0.007 | 0.700 |
| 1.175 | −0.076 | 0.700 |
| 1.338 | −0.255 | 0.700 |
| 1.500 | −0.444 | 0.700 |
| 1.509 | −0.454 | 0.700 |
| 1.676 | −0.660 | 0.700 |
| 1.812 | −0.835 | 0.700 |
| 1.829 | −0.857 | 0.700 |
| 1.959 | −1.032 | 0.700 |
| 2.062 | −1.174 | 0.700 |
| 2.092 | −1.214 | 0.700 |
| 2.226 | −1.402 | 0.700 |
| 2.226 | −1.402 | 0.700 |
| 2.238 | −1.419 | 0.700 |
| 2.250 | −1.437 | 0.700 |
| 2.261 | −1.454 | 0.700 |
| 2.261 | −1.454 | 0.700 |
| 2.300 | −1.518 | 0.700 |
| 2.340 | −1.582 | 0.700 |
| 2.379 | −1.647 | 0.700 |
| 2.379 | −1.647 | 0.700 |
| 2.384 | −1.654 | 0.700 |
| 2.387 | −1.662 | 0.700 |
| 2.390 | −1.668 | 0.700 |
| 2.392 | −1.675 | 0.700 |
| 2.393 | −1.681 | 0.700 |
| 2.393 | −1.686 | 0.700 |
| 2.391 | −1.691 | 0.700 |
| 2.388 | −1.695 | 0.700 |
| 2.321 | −1.683 | 0.800 |
| 2.310 | −1.693 | 0.800 |
| 2.298 | −1.703 | 0.800 |
| 2.287 | −1.713 | 0.800 |
| 2.287 | −1.713 | 0.800 |
| 2.286 | −1.714 | 0.800 |
| 2.285 | −1.715 | 0.800 |
| 2.283 | −1.716 | 0.800 |
| 2.282 | −1.716 | 0.800 |
| 2.280 | −1.716 | 0.800 |
| 2.279 | −1.716 | 0.800 |
| 2.277 | −1.716 | 0.800 |
| 2.276 | −1.715 | 0.800 |
| 2.275 | −1.714 | 0.800 |
| 2.274 | −1.713 | 0.800 |
| 2.274 | −1.713 | 0.800 |
| 2.171 | −1.621 | 0.800 |
| 2.152 | −1.604 | 0.800 |
| 2.002 | −1.468 | 0.800 |
| 1.999 | −1.466 | 0.800 |
| 1.818 | −1.299 | 0.800 |
| 1.780 | −1.264 | 0.800 |
| 1.683 | −1.177 | 0.800 |
| 1.537 | −1.050 | 0.800 |
| 1.518 | −1.034 | 0.800 |
| 1.476 | −1.000 | 0.800 |
| 1.417 | −0.952 | 0.800 |
| 1.354 | −0.901 | 0.800 |
| 1.220 | −0.797 | 0.800 |
| 1.089 | −0.696 | 0.800 |
| 1.020 | −0.644 | 0.800 |
| 0.809 | −0.491 | 0.800 |
| 0.708 | −0.421 | 0.800 |
| 0.607 | −0.354 | 0.800 |
| 0.404 | −0.228 | 0.800 |
| 0.334 | −0.188 | 0.800 |
| 0.172 | −0.099 | 0.800 |
| 0.011 | −0.022 | 0.800 |
| 0.009 | −0.020 | 0.800 |

TABLE 1-continued

| X | Y | Z |
|---|---|---|
| −0.142 | 0.042 | 0.800 |
| −0.378 | 0.119 | 0.800 |
| −0.589 | 0.161 | 0.800 |
| −0.690 | 0.170 | 0.800 |
| −0.877 | 0.167 | 0.800 |
| −1.061 | 0.138 | 0.800 |
| −1.165 | 0.110 | 0.800 |
| −1.294 | 0.061 | 0.800 |
| −1.424 | −0.002 | 0.800 |
| −1.647 | −0.150 | 0.800 |
| −1.647 | −0.150 | 0.800 |
| −1.681 | −0.175 | 0.800 |
| −1.714 | −0.199 | 0.800 |
| −1.747 | −0.222 | 0.800 |
| −1.780 | −0.243 | 0.800 |
| −1.812 | −0.263 | 0.800 |
| −1.842 | −0.281 | 0.800 |
| −1.872 | −0.297 | 0.800 |
| −1.901 | −0.311 | 0.800 |
| −1.930 | −0.324 | 0.800 |
| −1.959 | −0.335 | 0.800 |
| −1.987 | −0.344 | 0.800 |
| −2.015 | −0.351 | 0.800 |
| −2.042 | −0.356 | 0.800 |
| −2.068 | −0.359 | 0.800 |
| −2.094 | −0.359 | 0.800 |
| −2.118 | −0.357 | 0.800 |
| −2.140 | −0.351 | 0.800 |
| −2.161 | −0.343 | 0.800 |
| −2.179 | −0.331 | 0.800 |
| −2.196 | −0.317 | 0.800 |
| −2.211 | −0.300 | 0.800 |
| −2.225 | −0.280 | 0.800 |
| −2.238 | −0.257 | 0.800 |
| −2.248 | −0.233 | 0.800 |
| −2.257 | −0.209 | 0.800 |
| −2.263 | −0.183 | 0.800 |
| −2.268 | −0.154 | 0.800 |
| −2.271 | −0.123 | 0.800 |
| −2.273 | −0.088 | 0.800 |
| −2.271 | −0.049 | 0.800 |
| −2.267 | −0.005 | 0.800 |
| −2.259 | 0.043 | 0.800 |
| −2.248 | 0.096 | 0.800 |
| −2.231 | 0.155 | 0.800 |
| −2.207 | 0.218 | 0.800 |
| −2.176 | 0.288 | 0.800 |
| −2.176 | 0.288 | 0.800 |
| −2.100 | 0.425 | 0.800 |
| −2.018 | 0.550 | 0.800 |
| −2.001 | 0.572 | 0.800 |
| −1.838 | 0.758 | 0.800 |
| −1.717 | 0.864 | 0.800 |
| −1.712 | 0.868 | 0.800 |
| −1.564 | 0.967 | 0.800 |
| −1.436 | 1.030 | 0.800 |
| −1.386 | 1.050 | 0.800 |
| −1.190 | 1.100 | 0.800 |
| −1.097 | 1.112 | 0.800 |
| −1.014 | 1.117 | 0.800 |
| −0.850 | 1.111 | 0.800 |
| −0.507 | 1.042 | 0.800 |
| −0.480 | 1.034 | 0.800 |
| −0.215 | 0.926 | 0.800 |
| −0.015 | 0.820 | 0.800 |
| 0.182 | 0.696 | 0.800 |
| 0.280 | 0.628 | 0.800 |
| 0.359 | 0.570 | 0.800 |
| 0.528 | 0.437 | 0.800 |
| 0.695 | 0.294 | 0.800 |
| 1.043 | −0.041 | 0.800 |
| 1.121 | −0.122 | 0.800 |
| 1.280 | −0.296 | 0.800 |
| 1.440 | −0.480 | 0.800 |
| 1.448 | −0.490 | 0.800 |
| 1.614 | −0.689 | 0.800 |
| 1.749 | −0.859 | 0.800 |
| 1.765 | −0.880 | 0.800 |

TABLE 1-continued

| X | Y | Z |
|---|---|---|
| 1.894 | −1.049 | 0.800 |
| 1.997 | −1.185 | 0.800 |
| 2.026 | −1.223 | 0.800 |
| 2.154 | −1.395 | 0.800 |
| 2.154 | −1.395 | 0.800 |
| 2.165 | −1.412 | 0.800 |
| 2.177 | −1.428 | 0.800 |
| 2.188 | −1.445 | 0.800 |
| 2.188 | −1.445 | 0.800 |
| 2.229 | −1.508 | 0.800 |
| 2.270 | −1.571 | 0.800 |
| 2.311 | −1.635 | 0.800 |
| 2.311 | −1.635 | 0.800 |
| 2.316 | −1.643 | 0.800 |
| 2.320 | −1.650 | 0.800 |
| 2.323 | −1.657 | 0.800 |
| 2.325 | −1.663 | 0.800 |
| 2.326 | −1.669 | 0.800 |
| 2.326 | −1.675 | 0.800 |
| 2.324 | −1.680 | 0.800 |
| 2.321 | −1.683 | 0.800 |
| 2.250 | −1.669 | 0.900 |
| 2.239 | −1.680 | 0.900 |
| 2.228 | −1.690 | 0.900 |
| 2.217 | −1.700 | 0.900 |
| 2.217 | −1.700 | 0.900 |
| 2.216 | −1.701 | 0.900 |
| 2.215 | −1.702 | 0.900 |
| 2.214 | −1.703 | 0.900 |
| 2.212 | −1.703 | 0.900 |
| 2.211 | −1.703 | 0.900 |
| 2.209 | −1.703 | 0.900 |
| 2.208 | −1.703 | 0.900 |
| 2.207 | −1.702 | 0.900 |
| 2.205 | −1.702 | 0.900 |
| 2.204 | −1.701 | 0.900 |
| 2.204 | −1.701 | 0.900 |
| 2.098 | −1.610 | 0.900 |
| 2.078 | −1.594 | 0.900 |
| 1.925 | −1.464 | 0.900 |
| 1.922 | −1.461 | 0.900 |
| 1.738 | −1.299 | 0.900 |
| 1.699 | −1.264 | 0.900 |
| 1.602 | −1.177 | 0.900 |
| 1.455 | −1.051 | 0.900 |
| 1.435 | −1.035 | 0.900 |
| 1.394 | −1.001 | 0.900 |
| 1.336 | −0.954 | 0.900 |
| 1.275 | −0.905 | 0.900 |
| 1.147 | −0.802 | 0.900 |
| 1.022 | −0.704 | 0.900 |
| 0.957 | −0.654 | 0.900 |
| 0.756 | −0.502 | 0.900 |
| 0.660 | −0.431 | 0.900 |
| 0.562 | −0.363 | 0.900 |
| 0.365 | −0.231 | 0.900 |
| 0.298 | −0.188 | 0.900 |
| 0.138 | −0.092 | 0.900 |
| −0.021 | −0.005 | 0.900 |
| −0.023 | −0.004 | 0.900 |
| −0.174 | 0.070 | 0.900 |
| −0.412 | 0.165 | 0.900 |
| −0.619 | 0.219 | 0.900 |
| −0.716 | 0.233 | 0.900 |
| −0.893 | 0.240 | 0.900 |
| −1.070 | 0.225 | 0.900 |
| −1.171 | 0.205 | 0.900 |
| −1.297 | 0.169 | 0.900 |
| −1.424 | 0.116 | 0.900 |
| −1.651 | −0.016 | 0.900 |
| −1.651 | −0.016 | 0.900 |
| −1.685 | −0.038 | 0.900 |
| −1.719 | −0.060 | 0.900 |
| −1.753 | −0.082 | 0.900 |
| −1.788 | −0.103 | 0.900 |
| −1.824 | −0.123 | 0.900 |
| −1.861 | −0.142 | 0.900 |
| −1.898 | −0.159 | 0.900 |

TABLE 1-continued

| X | Y | Z |
|---|---|---|
| −1.936 | −0.174 | 0.900 |
| −1.974 | −0.186 | 0.900 |
| −2.009 | −0.195 | 0.900 |
| −2.040 | −0.199 | 0.900 |
| −2.068 | −0.200 | 0.900 |
| −2.093 | −0.198 | 0.900 |
| −2.117 | −0.194 | 0.900 |
| −2.139 | −0.186 | 0.900 |
| −2.160 | −0.176 | 0.900 |
| −2.179 | −0.162 | 0.900 |
| −2.197 | −0.146 | 0.900 |
| −2.212 | −0.127 | 0.900 |
| −2.226 | −0.106 | 0.900 |
| −2.238 | −0.082 | 0.900 |
| −2.248 | −0.057 | 0.900 |
| −2.255 | −0.031 | 0.900 |
| −2.261 | −0.003 | 0.900 |
| −2.264 | 0.028 | 0.900 |
| −2.266 | 0.059 | 0.900 |
| −2.265 | 0.093 | 0.900 |
| −2.263 | 0.127 | 0.900 |
| −2.259 | 0.163 | 0.900 |
| −2.253 | 0.198 | 0.900 |
| −2.245 | 0.232 | 0.900 |
| −2.237 | 0.267 | 0.900 |
| −2.226 | 0.301 | 0.900 |
| −2.215 | 0.335 | 0.900 |
| −2.201 | 0.369 | 0.900 |
| −2.186 | 0.404 | 0.900 |
| −2.168 | 0.439 | 0.900 |
| −2.168 | 0.439 | 0.900 |
| −2.089 | 0.577 | 0.900 |
| −2.004 | 0.699 | 0.900 |
| −1.986 | 0.721 | 0.900 |
| −1.820 | 0.890 | 0.900 |
| −1.698 | 0.980 | 0.900 |
| −1.693 | 0.983 | 0.900 |
| −1.545 | 1.061 | 0.900 |
| −1.417 | 1.105 | 0.900 |
| −1.365 | 1.117 | 0.900 |
| −1.169 | 1.140 | 0.900 |
| −1.076 | 1.138 | 0.900 |
| −0.995 | 1.131 | 0.900 |
| −0.835 | 1.104 | 0.900 |
| −0.503 | 0.996 | 0.900 |
| −0.477 | 0.985 | 0.900 |
| −0.225 | 0.860 | 0.900 |
| −0.039 | 0.747 | 0.900 |
| 0.144 | 0.621 | 0.900 |
| 0.235 | 0.554 | 0.900 |
| 0.309 | 0.496 | 0.900 |
| 0.468 | 0.367 | 0.900 |
| 0.628 | 0.228 | 0.900 |
| 0.965 | −0.096 | 0.900 |
| 1.042 | −0.175 | 0.900 |
| 1.202 | −0.345 | 0.900 |
| 1.360 | −0.520 | 0.900 |
| 1.368 | −0.529 | 0.900 |
| 1.529 | −0.716 | 0.900 |
| 1.663 | −0.876 | 0.900 |
| 1.680 | −0.896 | 0.900 |
| 1.810 | −1.058 | 0.900 |
| 1.915 | −1.188 | 0.900 |
| 1.945 | −1.226 | 0.900 |
| 2.073 | −1.387 | 0.900 |
| 2.073 | −1.387 | 0.900 |
| 2.086 | −1.403 | 0.900 |
| 2.097 | −1.419 | 0.900 |
| 2.109 | −1.435 | 0.900 |
| 2.109 | −1.435 | 0.900 |
| 2.152 | −1.497 | 0.900 |
| 2.195 | −1.559 | 0.900 |
| 2.239 | −1.622 | 0.900 |
| 2.239 | −1.622 | 0.900 |
| 2.243 | −1.629 | 0.900 |
| 2.248 | −1.636 | 0.900 |
| 2.251 | −1.643 | 0.900 |
| 2.253 | −1.649 | 0.900 |

TABLE 1-continued

| X | Y | Z |
|---|---|---|
| 2.254 | −1.655 | 0.900 |
| 2.254 | −1.661 | 0.900 |
| 2.253 | −1.665 | 0.900 |
| 2.250 | −1.669 | 0.900 |
| 2.174 | −1.656 | 1.000 |
| 2.164 | −1.665 | 1.000 |
| 2.155 | −1.675 | 1.000 |
| 2.145 | −1.684 | 1.000 |
| 2.145 | −1.684 | 1.000 |
| 2.144 | −1.685 | 1.000 |
| 2.143 | −1.686 | 1.000 |
| 2.142 | −1.687 | 1.000 |
| 2.140 | −1.687 | 1.000 |
| 2.139 | −1.687 | 1.000 |
| 2.137 | −1.687 | 1.000 |
| 2.136 | −1.687 | 1.000 |
| 2.135 | −1.687 | 1.000 |
| 2.133 | −1.686 | 1.000 |
| 2.132 | −1.685 | 1.000 |
| 2.132 | −1.685 | 1.000 |
| 2.022 | −1.599 | 1.000 |
| 2.001 | −1.583 | 1.000 |
| 1.846 | −1.461 | 1.000 |
| 1.843 | −1.458 | 1.000 |
| 1.655 | −1.301 | 1.000 |
| 1.615 | −1.267 | 1.000 |
| 1.515 | −1.180 | 1.000 |
| 1.365 | −1.053 | 1.000 |
| 1.345 | −1.037 | 1.000 |
| 1.304 | −1.003 | 1.000 |
| 1.247 | −0.956 | 1.000 |
| 1.187 | −0.908 | 1.000 |
| 1.064 | −0.807 | 1.000 |
| 0.941 | −0.707 | 1.000 |
| 0.874 | −0.654 | 1.000 |
| 0.669 | −0.493 | 1.000 |
| 0.571 | −0.420 | 1.000 |
| 0.475 | −0.348 | 1.000 |
| 0.290 | −0.216 | 1.000 |
| 0.229 | −0.174 | 1.000 |
| 0.085 | −0.079 | 1.000 |
| −0.062 | 0.012 | 1.000 |
| −0.065 | 0.014 | 1.000 |
| −0.211 | 0.098 | 1.000 |
| −0.438 | 0.210 | 1.000 |
| −0.628 | 0.275 | 1.000 |
| −0.721 | 0.296 | 1.000 |
| −0.902 | 0.317 | 1.000 |
| −1.084 | 0.314 | 1.000 |
| −1.184 | 0.302 | 1.000 |
| −1.308 | 0.276 | 1.000 |
| −1.432 | 0.235 | 1.000 |
| −1.650 | 0.125 | 1.000 |
| −1.650 | 0.125 | 1.000 |
| −1.669 | 0.114 | 1.000 |
| −1.688 | 0.103 | 1.000 |
| −1.707 | 0.092 | 1.000 |
| −1.726 | 0.081 | 1.000 |
| −1.746 | 0.070 | 1.000 |
| −1.769 | 0.058 | 1.000 |
| −1.795 | 0.045 | 1.000 |
| −1.824 | 0.031 | 1.000 |
| −1.854 | 0.017 | 1.000 |
| −1.883 | 0.005 | 1.000 |
| −1.912 | −0.007 | 1.000 |
| −1.941 | −0.017 | 1.000 |
| −1.971 | −0.026 | 1.000 |
| −2.003 | −0.032 | 1.000 |
| −2.033 | −0.036 | 1.000 |
| −2.063 | −0.035 | 1.000 |
| −2.091 | −0.031 | 1.000 |
| −2.118 | −0.023 | 1.000 |
| −2.145 | −0.010 | 1.000 |
| −2.170 | 0.007 | 1.000 |
| −2.194 | 0.028 | 1.000 |
| −2.215 | 0.053 | 1.000 |
| −2.233 | 0.081 | 1.000 |
| −2.247 | 0.112 | 1.000 |

TABLE 1-continued

| X | Y | Z |
|---|---|---|
| −2.257 | 0.146 | 1.000 |
| −2.262 | 0.184 | 1.000 |
| −2.264 | 0.226 | 1.000 |
| −2.263 | 0.273 | 1.000 |
| −2.257 | 0.327 | 1.000 |
| −2.245 | 0.386 | 1.000 |
| −2.228 | 0.451 | 1.000 |
| −2.203 | 0.521 | 1.000 |
| −2.168 | 0.596 | 1.000 |
| −2.168 | 0.596 | 1.000 |
| −2.100 | 0.716 | 1.000 |
| −2.031 | 0.815 | 1.000 |
| −1.962 | 0.897 | 1.000 |
| −1.891 | 0.966 | 1.000 |
| −1.818 | 1.023 | 1.000 |
| −1.743 | 1.072 | 1.000 |
| −1.664 | 1.111 | 1.000 |
| −1.583 | 1.141 | 1.000 |
| −1.499 | 1.163 | 1.000 |
| −1.411 | 1.176 | 1.000 |
| −1.318 | 1.180 | 1.000 |
| −1.216 | 1.175 | 1.000 |
| −1.102 | 1.157 | 1.000 |
| −0.973 | 1.125 | 1.000 |
| −0.830 | 1.077 | 1.000 |
| −0.671 | 1.011 | 1.000 |
| −0.497 | 0.924 | 1.000 |
| −0.305 | 0.811 | 1.000 |
| −0.095 | 0.670 | 1.000 |
| 0.015 | 0.590 | 1.000 |
| 0.126 | 0.505 | 1.000 |
| 0.236 | 0.416 | 1.000 |
| 0.348 | 0.322 | 1.000 |
| 0.578 | 0.119 | 1.000 |
| 0.703 | 0.003 | 1.000 |
| 0.833 | −0.121 | 1.000 |
| 1.099 | −0.390 | 1.000 |
| 1.357 | −0.666 | 1.000 |
| 1.593 | −0.928 | 1.000 |
| 1.797 | −1.161 | 1.000 |
| 1.983 | −1.374 | 1.000 |
| 1.983 | −1.374 | 1.000 |
| 1.998 | −1.393 | 1.000 |
| 2.014 | −1.412 | 1.000 |
| 2.029 | −1.431 | 1.000 |
| 2.029 | −1.431 | 1.000 |
| 2.073 | −1.490 | 1.000 |
| 2.117 | −1.549 | 1.000 |
| 2.161 | −1.608 | 1.000 |
| 2.161 | −1.608 | 1.000 |
| 2.166 | −1.616 | 1.000 |
| 2.170 | −1.623 | 1.000 |
| 2.174 | −1.629 | 1.000 |
| 2.176 | −1.635 | 1.000 |
| 2.178 | −1.641 | 1.000 |
| 2.178 | −1.647 | 1.000 |
| 2.177 | −1.652 | 1.000 |
| 2.174 | −1.656 | 1.000 |

Although a preferred embodiment of this invention has been disclosed, a worker of ordinary skill in this art would recognize that certain modifications would come within the scope of this invention. For that reason, the following claims should be studied to determine the true scope and content of this invention. Since many possible embodiments may be made of the invention without departing from the scope thereof, it is to be understood that all matter herein set forth or shown in the accompanying drawings is to be interpreted as illustrative and not in a limiting sense.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the invention, what is claimed is:

1. A turbine blade comprising:

a blade root;

a platform extending from the blade root; and, an airfoil extending from the platform, the airfoil having an airfoil shape, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape.

2. The turbine blade of claim 1 forming a part of a first stage turbine of a gas turbine engine.

3. : The turbine blade of claim 1, wherein the turbine blade has an airfoil height measured from a midpoint of the platform to a tip of the airfoil being 7.3 inches.

4. The turbine blade of claim 1 further comprising a coating applied to the airfoil.

5. The turbine blade of claim 1, wherein an orientation of the airfoil is rotatable about an axis extending along the Z values.

6. The turbine blade of claim 1, wherein the X and Y values are scalable by a first constant and the Z values are scalable by a second constant.

7. : A turbine blade comprising: a blade root; a platform extending from the blade root; and, an airfoil extending from the platform, the airfoil having an airfoil shape within an envelope of −0.033 to +0.033 inches in a direction normal to any surface location of the airfoil, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape.

8. The turbine blade of claim 7 forming a part of a first stage turbine of a gas turbine engine.

9. : The turbine blade of claim 7, wherein the turbine blade has an airfoil height measured from a midpoint of the platform to a tip of the airfoil being 7.3 inches.

10. The turbine blade of claim 7 further comprising a coating applied to the airfoil.

11. The turbine blade of claim 7, wherein the X and Y values are scalable by a first constant and the Z values are scalable by a second constant.

12. The turbine blade of claim 7, wherein an orientation of the airfoil is rotatable about an axis extending along the Z values.

13. A turbine comprising:

a turbine wheel positioned along an engine centerline;

a plurality of turbine blades secured to the turbine wheel, each turbine blade comprising:

a blade root;

a platform extending radially outward from the blade root; and, an airfoil extending radially outward from the platform, the airfoil having an airfoil shape, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape.

14. The turbine of claim 13 forming a part of a first stage of a gas turbine engine.

15. The turbine of claim 13, wherein the turbine blade has an airfoil height measured from a midpoint of the platform to a tip of the airfoil being 7.3 inches.

16. The turbine of claim 13, wherein the turbine blade further comprises a coating applied to the airfoil.

17. The turbine blade of claim 13, wherein an orientation of the airfoil is rotatable about an axis extending along the Z values.

18. The turbine blade of claim 13, wherein the X and Y values are scalable by a first constant and the Z values are scalable by a second constant.

19. : A turbine comprising: a turbine wheel positioned along an engine centerline; a plurality of turbine blades secured to the turbine wheel, each turbine blade comprising: a blade root; a platform extending from the blade root; and, an airfoil extending from the platform, the airfoil having an airfoil shape within an envelope of −0.033 to +0.033 inches in a direction normal to any surface location of the airfoil, the airfoil having a nominal profile substantially in accordance with Cartesian coordinate values of X, Y, and Z set forth in Table 1 wherein the Z values are non-dimensional values from 0 to 1 convertible to Z distances in inches by multiplying the Z values by a height of the airfoil in inches, and wherein the X and Y are distances in inches which, when connected by smooth continuing arcs, define airfoil profile sections at each distance Z, the profile sections at the Z distances being joined smoothly with one another to form a complete airfoil shape.

20. The turbine of claim 19 forming a part of a first stage of a gas turbine engine.

21. The turbine of claim 19, wherein the turbine blade has an airfoil height measured from a midpoint of the platform to a tip of the airfoil being 7.3 inches.

22. The turbine of claim 19, wherein the turbine blade further comprises a coating applied to the airfoil.

23. The turbine blade of claim 19, wherein an orientation of the airfoil is rotatable about an axis extending along the Z values.

24. The turbine blade of claim 19, wherein the X and Y values are scalable by a first constant and the Z values are scalable by a second constant.

* * * * *